US009895898B2

(12) United States Patent
Pourtier et al.

(10) Patent No.: US 9,895,898 B2
(45) Date of Patent: Feb. 20, 2018

(54) LID FOR AN INK RESERVOIR WITH MIXING FUNCTION

(71) Applicant: Dover Europe Sàrl, Vernier (CH)

(72) Inventors: Francis Pourtier, Charmes (FR); Jean-Pierre Arpin, Beaumont-Monteux (FR); Thomas Marzano, Romans sur Isere (FR)

(73) Assignee: Dover Europe Sàrl, Vernier (CH)

( * ) Notice: Subject to any disclaimer, the term of this patent is extended or adjusted under 35 U.S.C. 154(b) by 0 days.

(21) Appl. No.: 15/223,543

(22) Filed: Jul. 29, 2016

(65) Prior Publication Data

US 2017/0028736 A1 Feb. 2, 2017

(30) Foreign Application Priority Data

Jul. 30, 2015 (FR) ..... 15 57326

(51) Int. Cl.
*B41J 2/175* (2006.01)

(52) U.S. Cl.
CPC ..... *B41J 2/17523* (2013.01); *B41J 2/17513* (2013.01); *B41J 2/17526* (2013.01); *B41J 2/17553* (2013.01)

(58) Field of Classification Search
CPC ..... B41J 2/17506; B41J 2/17513; B41J 2/17523; B41J 2/17526; B41J 2/17546; B41J 2/17553; B41J 2/17559
See application file for complete search history.

(56) References Cited

U.S. PATENT DOCUMENTS 4,968,998 A * 11/1990 Allen ..... B41J 2/17513 347/7
5,199,470 A * 4/1993 Goldman ..... B43L 25/007 141/1

(Continued)

FOREIGN PATENT DOCUMENTS

EP 1 231 064 A2 8/2002
EP 1 364 795 A2 11/2003

(Continued)

OTHER PUBLICATIONS

Extended European Search Report issued in Patent Application No. EP 16 18 1969 dated Feb. 17, 2017.

(Continued)

*Primary Examiner* — Anh T. N. Vo
(74) *Attorney, Agent, or Firm* — Pearne & Gordon LLP

(57) ABSTRACT

The invention relates to a reservoir lid for a continuous ink jet printer, including a so-called upper surface (33$_1$), a so-called lower surface (33$_2$), between which are included an upper part (33*a*) and a lower part (33*b*) of the lid, at least the latter being delimited sideways by a peripheral surface ($S_e$), and: at least one 1$^{st}$ duct (331), which passes through at least one part of the lid, for leading a 1$^{st}$ fluid from said upper part to said lower part and direct it, at least partly, sideways, to said peripheral surface ($S_e$), at least one 1$^{st}$ chamber (333) delimited by an internal surface into which said duct opens and by said peripheral surface ($S_e$), and means (338) for flowing a liquid contained in this chamber along said peripheral surface.

20 Claims, 13 Drawing Sheets

(56) References Cited

U.S. PATENT DOCUMENTS

| | | | | |
|---|---|---|---|---|
| 6,089,686 | A * | 7/2000 | Thornton | B41J 2/17509 347/7 |
| 6,386,691 | B1 | 5/2002 | Liu | |
| 7,249,831 | B2 * | 7/2007 | Childers | B41J 2/17506 347/85 |
| 7,306,330 | B2 * | 12/2007 | Ikezaki | B41J 2/17523 347/49 |
| 8,070,273 | B2 * | 12/2011 | Kawasaki | B41J 2/17513 347/86 |
| 8,517,518 | B2 * | 8/2013 | Kashu | B41J 2/1404 347/66 |
| 2003/0011667 | A1 | 1/2003 | Jones | |
| 2004/0145636 | A1 | 7/2004 | Gonzales | |
| 2009/0122121 | A1 | 5/2009 | Kawasaki | |
| 2012/0299989 | A1 | 11/2012 | Prothon | |
| 2016/0039216 | A1 | 2/2016 | Ribiero | |
| 2016/0052291 | A1 | 2/2016 | Pourtier | |
| 2016/0114590 | A1 | 4/2016 | Arpin | |

FOREIGN PATENT DOCUMENTS

| | | |
|---|---|---|
| EP | 1 772 270 A2 | 4/2007 |
| FR | 2 827 213 A1 | 1/2003 |

OTHER PUBLICATIONS

Search Report issued in French Patent Application No. FR 1557326 dated May 19, 2016.

United States Utility U.S. Appl. No. 15/088,190,"Method and Device for Maintenance and Protection of a Hydraulic Connection" filed Apr. 1, 2016.

United States Utility U.S. Appl. No. 15/151,980, "Method and Device for Partial Maintenance of a Hydraulic Circuit" filed May 11, 2016.

United States Utility U.S. Appl. No. 15/165,340, "Method and Device for Managing Ink Quality in an Inkjet Printer" filed May 26, 2016.

Machine translation of French Patent Publication 2827213.

* cited by examiner

LID FOR AN INK RESERVOIR WITH MIXING FUNCTION

TECHNICAL FIELD AND PRIOR ART

The invention relates to the domain of continuous inkjet printers (CIJ).

It also relates to the architecture (the layout of the ink circuit) of CIJ printers, particularly in order to guarantee homogeneity of the ink.

Continuous inkjet (CIJ) printers are well known in the field of coding and industrial marking of various products, for example for high speed marking of barcodes, expiration dates on food products or references or distance marks on cables or pipes directly on the production line. This type of printer is also used in some decoration domains in which the technological possibilities of graphic printing are exploited.

These printers have several subassemblies of the type shown in FIG. 1.

Firstly, a print head 1 usually offset from the body of the printer 3, is connected to the body through a flexible umbilical line 119 including hydraulic and electrical connections necessary for operation of the head by giving it flexibility that facilitates integration on the production line.

The body of the printer 3 (also called the cabinet) usually comprises three subassemblies:

an ink circuit in the bottom part of the cabinet (zone 4'), that firstly supplies a suitable quality ink to the head at a stable pressure, and secondly makes it possible to handle ink from jets that is not used for printing, a controller located in the top of the cabinet (zone 5'), capable of managing action sequences and performing treatments for activation of different functions of the ink circuit and the head.

an interface 6 that provides the operator with the means of using the printer and being informed about its operation.

In other words, the cabinet comprises 2 subassemblies: the electronics and the electrical power supply and the operator interface at the top, and an ink circuit supplying nominal quality ink to the head at positive pressure and recovering ink not used by the head at negative pressure, at the bottom.

FIG. 2 diagrammatically shows a print head 1 of a CIJ printer. It comprises a drop generator 60 supplied with pressurised electrically conducting ink by the ink circuit 4.

This generator is capable of emitting at least one continuous jet through a small dimension port called the nozzle. The jet is transformed into a regular sequence of identical size drops under the action of a periodic stimulation system (not shown) on the upstream side of the nozzle outlet. When the drops 7 are not to be used for printing, they are directed towards a gutter 62 that recovers them so as to recycle unused ink by returning the drops to the ink circuit 4. Devices 61 placed along the jet (charge and deflection electrodes) electrically charge the drops on order and deflect them in an electrical field Ed. These drops are then diverted from their natural ejection trajectory from the drop generator. The drops 9 intended for printing are not directed to the gutter and are deposited on the support to be printed 8.

This description can be applied to continuous inkjet (CIJ) printers called binary printers or continuous multi-deflected jet printers. Binary CIJ printers are fitted with a head in which the drop generator has a multitude of jets, each drop in a jet can only be oriented towards only two trajectories, namely print or recovery. In multi-deflected continuous jet printers, each drop in a single jet (or a few spaced jets) may be deflected on different trajectories corresponding to charge commands that are different from one drop to the next, thus scanning the zone to be printed along a direction that is the deflection direction, the other scanning direction of the zone to be printed is covered by a relative displacement of the print head and the support to be printed 8. In general, the elements are arranged such that these 2 directions are approximately perpendicular.

An ink circuit of a continuous inkjet printer supplies firstly ink at regulated pressure, and possibly solvent, to the drop generator of the head 1 and creates a negative pressure to recover fluids not used for printing in return from the head.

It also manages consumables (ink and solvent distribution from a chamber) and controls and maintains the ink quality (viscosity/concentration).

Finally, other functions are related to user comfort and to the automatic handling of some maintenance operations in order to guarantee identical operation regardless of usage conditions. These functions include rinsing of the head with solvent (drop generator, nozzle, gutter), assistance with preventive maintenance such as replacement of limited life components (filters, pumps).

These various functions have very different purposes and technical requirements. They are activated and sequenced by the printer controller that will be more complex if there is a large number of sophisticated functions.

Inks containing pigments such as titanium oxide (rutile $TiO_2$ or anatase) in the form of sub-micronic size particles are particularly attractive for their whiteness and their opacity. They are used for marking and identification of black or dark supports.

Dense pigment particles naturally tend to sediment when ink is at rest.

The consequences of this inevitable sedimentation can be blocking of pipes or loss of opaqueness of markings. Therefore the ink circuit must be able to stir ink in one way or another such that the ink can maintain its homogeneity, or restore it after a fairly long rest time.

On the other hand, the viscosity, upon using a printer, will change from one value to another. In other words, the viscosity will not be a stable parameter during the operation of the printer. This viscosity variation is mainly due to three factors:

solvent evaporation, solvent addition in the ink reservoir, which results from washing operations of all or part of the fluid circuit; these operations are performed using a solvent which is, following such operations, sent to the main reservoir, temperature variations.

The ink quality (measured by the viscosity) is thus maintained by additions of solvent into the ink. Consequently, a problem arises of the optimum mixing of the ink and added solvent.

Another difficulty related to the ink quality is the presence of foam in the ink reservoir into which unprinted ink recovered by the print head gutter is returned. This foam is created by the inevitable intake of air with ink recovered through the gutter. In particular, water-based inks foam more than solvent-based inks. This air is evacuated through a vent. Preferably the ink circuit can defoam the ink sufficiently quickly to avoid creating an ink overflow through the vent. The question of recycling air mixed with ink to the head also arises.

In the specific field of ink jet printers, solutions have been suggested to meet the requirements related to the presence of dense pigments in the inks and/or to recover the ink not printed via the gutter of the printing head and/or to mix the solvent added to the ink, regardless of whether it is a solvent added to compensate for a solvent variation or for washing operations.

A 1st solution is set forth in FIG. 3A where reference 11 designates a reservoir which contains ink 13, which can be drawn off via a duct 111 disposed in the bottom of the reservoir, for sending it to the printing head 1.

According to this solution, a liquid (solvent and/or ink) which is fed to the circuit is introduced inside the ink volume 13 already present in the reservoir, under the free surface of this ink 13. The ink which is fed can be ink which comes from an external cartridge, or ink which comes back from the printing head. The solvent which is fed can be solvent which comes from an external cartridge. But this solution causes high pressure variations at the outlet of the duct 111, because of viscosity variations upon introducing the solvent.

A 2nd solution is set forth in FIG. 3B where identical references to those of FIG. 3A designate the same elements.

According to this solution, a liquid (solvent and/or ink) which is fed to the circuit is introduced above the ink volume 13 already present in the reservoir, above the free surface of this ink 13. Once again, the ink which is fed can be ink which comes from an external cartridge, or ink which comes back from the printing head. The solvent which is fed can be solvent which comes from an external cartridge. But this solution causes the formation of two phases, the ink 13 on the one hand and, on the other hand, a phase $\mathbf{13}_1$ at the surface of the ink. This phase $\mathbf{13}_1$ substantially consists of solvent, which is not properly mixed with the ink.

A 3rd solution is set forth in FIG. 3C where identical references to those of FIGS. 3A and 3B designate the same elements.

According to this solution, ink E and solvent S are mixed by means 112 (for example a "T") before they are injected in the reservoir 11. The solvent can have the same origin as mentioned above. But this solution disturbs the hydraulic line on which the means 112 are located.

The problem arises of finding a new device and a new method for injecting ink and/or solvent in an ink reservoir of a CIJ type printer.

In general, the ink circuit of known inkjet printers capable of projecting dense pigment inks remains a costly element due to the large number of hydraulic components to be installed.

Therefore the problem arises of making some or all of the functions of an ink circuit in a CIJ type printer at low cost with a reduced number of components while guaranteeing minimum reliability, or in any case reliability expected by users, particularly related to homogeneity of pigment inks throughout consumption. Therefore a search is made to use the simplest possible components, particularly for functions such as controlling and maintaining the ink quality. This ink quality may be defined in terms of viscosity and/or concentration of the ink.

One particular problem is to reduce or to limit the variation in the opaqueness of the ink as a function of the ink consumption. The opaqueness of marking is related essentially (but not only) to the pigment concentration. If some of the pigments settle to the bottom of the reservoir, the pigment concentration in the liquid ink will be reduced and the opaqueness will be reduced.

Another problem is to reduce or to minimise the time necessary for homogenisation of the ink before printing is restarted, after a possibly long shutdown of the machine.

According to another aspect, the ink circuit comprises a large number of hydraulic, hydro-electric components, sensors, etc. Modern printers have many sophisticated and precise functions. Hydraulic components (pumps, solenoid valves, self-closing connections, filters, miscellaneous sensors) are present or are designed to satisfy a level of quality, reliability, performance and service for the user. And maintenance functions consume components because they are often automated.

Therefore there is also a need for an ink circuit architecture that minimises the number of components while guaranteeing a good level of performance and reliability and ease of maintenance allowing fast actions, minimising risks of dirt and that can be done by operators without any special training.

PRESENTATION OF THE INVENTION

The invention first relates to a reservoir lid for a continuous ink jet printer, including a so-called upper surface, a so-called lower surface, between which are included an upper part and a lower part of the lid, at least the latter being delimited sideways by a peripheral surface ($S_e$), or by an edge or a periphery defined by this peripheral surface, and:

at least one 1st duct, which passes through at least one part of the lid, for leading a 1st fluid from said upper part to said lower part and direct it, at least partly, sideways, to said peripheral surface ($S_e$), at least one 1st chamber delimited by an internal surface into which said duct opens and by said peripheral surface ($S_e$), and means for flowing a liquid contained in this chamber along a direction parallel to said peripheral surface or along this peripheral surface.

The invention thus enables a recover function of a fluid to be integrated, for example ink from a printing head, in a lid of a reservoir. The structure of this lid enables, when installed on a reservoir, the internal wall of the reservoir to be used to guide the fluid introduced into the reservoir to the fluid pool already contained in the reservoir. The chamber is thus disposed against the peripheral wall while facing it.

An internal surface of the 1st chamber faces, at least partly, the peripheral surface Se.

The peripheral surface is preferably straight and is an extension of the edge or the periphery of the lower part of the lid.

End or front faces of said internal surface can be aligned with, or be positioned in, the peripheral surface Se.

The internal surface of the chamber can include one or more walls.

An upper portion or wall of the 1st chamber may be formed or closed by the lower part or the lower surface of the lid.

An upper wall of the chamber can be formed in a portion of the lower part of the lid and/or an upper part of the chamber can be closed by the lower part of the lid. Preferably, this upper wall or upper part faces the means for flowing a liquid contained in the chamber along a direction parallel to said peripheral surface.

The chamber can be open onto the peripheral surface Se, the internal wall of the reservoir coming to close it sideways when the lid closes the reservoir. The internal wall of the reservoir however leaves free the means for flowing a liquid contained in the chamber along a direction parallel to the peripheral surface, preferably along the same.

Alternatively, the chamber includes a wall which can be wholly formed with the rest of the chamber and which in turn bears against the internal wall of the reservoir. The latter however leaves free the means for flowing a liquid contained in the chamber along a direction parallel to the peripheral surface, preferably along the same. This wall advantageously has a curvature which corresponds to the internal surface of the reservoir. This wall is nearly the same as the surface Se.

According to a particular embodiment, the upper surface and the lower surface of the lid can be at least partly parallel to each other and to a plane (XY). Alternatively, they can be at least partly bent or have a curvature.

The $1^{st}$ duct can pass through at least one part of the lid along at least one direction parallel to the peripheral surface ($S_e$), or perpendicular to the plane (XY).

The $1^{st}$ duct can pass through the lid, from the upper surface to the lower surface.

The $1^{st}$ duct can form a bend, thus causing the flow of a fluid flowing therethrough to change direction, to be finally directed to the surface Se.

The $1^{st}$ duct can open into the internal surface of the chamber, for example in a wall of the chamber, for example through at least one port made in said surface or said wall. Preferably, said surface or said wall faces at least partly said peripheral surface Se.

The peripheral surface is straight, it enables an extension direction to be defined, or an axis Z. In the following, several indications are given, in particular of an angle with respect to this peripheral surface (or a plane tangent thereto). But they can also be given with respect to the axis Z or a plane XY, perpendicular thereto.

Preferably, at least one part of the duct is directed to said peripheral surface ($S_e$) along a direction forming, with this surface, an angle between 30° and 60°.

Regardless of the embodiment contemplated, the peripheral surface ($S_e$) can be cylindrical.

According to one embodiment, the lower part of the lid includes at least one peripheral part which projects from said lower surface, at least one part of said $1^{st}$ chamber being made in said peripheral part.

Further, means can be provided to receive at least one measuring stick.

A lid according to the invention can further include fluid connection means, on the upper surface, to lead at least the $1^{st}$ fluid to an inlet of the $1^{st}$ duct.

Preferably, these fluid connection means include an inlet enabling the $1^{st}$ fluid to be led along a direction perpendicular to the peripheral surface ($S_e$) or, optionally, parallel to the plane (XY).

A lid according to the invention can further include side means, for example a throat to receive a seal, for a sealing with the wall of a reservoir, these side means being disposed between said $1^{st}$ chamber and the upper surface.

At least one further duct can advantageously pass through the upper part of the lid and open into a cavity delimited by the lower part. Such a duct enables the atmosphere present above an ink contained in a reservoir on which the lid is positioned to be put to atmospheric pressure.

Generally, the $1^{st}$ duct can open into said $1^{st}$ chamber alone.

According to one alternative, a lid according to the invention includes at least one $2^{nd}$ duct, which passes through at least one part of the lid, to lead a $2^{nd}$ fluid from said upper part to said lower part and direct it at least partly, sideways, to said peripheral surface ($S_e$), this $2^{nd}$ duct opening into the $1^{st}$ chamber. The $1^{st}$ duct and the $2^{nd}$ duct are advantageously at least partly parallel to each other.

According to this alternative, the $1^{st}$ chamber can accommodate 2 fluids, which will be able to be mixed to each other, and then the mixture can be directed to the fluid pool already contained in the reservoir. Both fluids can be, on the one hand, ink that comes from a flow from the reservoir itself, and on the other hand, ink that comes from an external supply, for example an ink or solvent cartridge which comes from an external supply, for example a solvent cartridge or an intermediate solvent reservoir.

The $2^{nd}$ duct can pass through at least one part of the lid along at least one direction parallel to the peripheral surface ($S_e$), or even perpendicular to the plane (XY).

The $2^{nd}$ duct can pass through the lid, from the upper surface to the lower surface. The $2^{nd}$ duct can, as the $1^{st}$ duct, form a bend, thus leading the flow of a fluid flowing therethrough to change direction, to be finally directed to the surface Se.

The $2^{nd}$ duct can open into the internal surface of the chamber, for example in a wall of the chamber, for example through at least one port made in said surface or said wall. Preferably, said surface or said wall faces at least partly said peripheral surface Se.

When the $1^{st}$ duct, respectively the $2^{nd}$ duct, opens into the $1^{st}$ chamber through a $1^{st}$ port, respectively a $2^{nd}$ port, the sum of the cross-section area of the $1^{st}$ port and the $2^{nd}$ port, through which the $1^{st}$ fluid and the $2^{nd}$ fluid pass, is preferably lower than or equal to the cross-section area of the means for discharging the liquid from the chamber.

The lid can further include:

at least one $3^{rd}$ duct, which passes at least one part of the lid, for leading a fluid, namely a liquid from said upper part to said lower part and direct it, at least partly, sideways, to said peripheral surface ($S_e$), at least one $2^{nd}$ chamber delimited by an internal surface into which opens said $3^{rd}$ duct and by said peripheral surface ($S_e$), and means for flowing the fluid from this $2^{nd}$ chamber along a direction parallel to said peripheral surface, or along this peripheral surface.

An upper portion or wall of the $2^{nd}$ chamber may be formed or closed by the lower part or the lower surface of the lid.

In this alternative, the lid includes, on the one hand, a chamber in which a mixture can be made and, on the other hand, a chamber which enables another fluid to be collected, for example ink from a printing head of a printer. Both chambers are separated from each other.

The 2 fluids to form the mixture can be, on the one hand, the ink that comes from a flow from the reservoir itself, and on the other, the ink that comes from an external supply, for example an ink cartridge, or solvent that comes from an external supply, for example a solvent cartridge or an intermediate solvent reservoir.

The $3^{rd}$ duct can open alone into said chamber.

An internal surface of the $2^{nd}$ chamber faces, at least partly, the peripheral surface Se. When the lid is in a position for closing the reservoir, the $2^{nd}$ chamber is disposed against the peripheral wall of the reservoir while facing it.

End or front faces of the internal surface of the $2^{nd}$ chamber can be aligned with, or be positioned in, the peripheral surface Se.

The internal surface of the $2^{nd}$ chamber can include one or more walls.

An upper wall of the chamber can be formed in a portion of the lower part of the lid and/or an upper part of the chamber can be closed by the lower part of the lid. Preferably, this upper part or upper wall faces means for flowing a liquid contained in the chamber along a direction parallel to said peripheral surface.

The $2^{nd}$ chamber can be open onto the peripheral surface Se, the internal wall of the reservoir closing it sideways when the lid closes the reservoir. The internal wall of the reservoir however leaves free the means for flowing a liquid contained in the chamber along a direction parallel to the peripheral surface, preferably along the same.

Alternatively, the $2^{nd}$ chamber includes a wall which can be integrally formed with the rest of the chamber and which in turn bears against the internal wall of the reservoir. The latter however leaves free the means for flowing a liquid contained in the $2^{nd}$ chamber along a direction parallel to the peripheral surface, preferably along the same. This wall advantageously has a curvature which corresponds to the internal surface of the reservoir. This wall is substantially the same as the surface Se.

The $3^{rd}$ duct can pass through at least one part of the lid along at least one direction parallel to the peripheral surface ($S_e$), or even perpendicular to the plane (XY).

The $3^{rd}$ duct can pass through the lid, from the upper surface to the lower surface. The $3^{rd}$ duct can form a bend, thus leading the flow of the fluid flowing therethrough to change direction, to be finally directed to the surface Se.

The $3^{rd}$ duct can open into the lower surface of the $2^{nd}$ chamber, for example in a wall of the chamber, for example through at least one orifice made in said surface or said wall. Preferably, said surface or said wall faces at least partly said peripheral surface Se. Regardless of the number of chamber(s) and, in each chamber, the number of ducts, either ducts, or each duct, enables, preferably, each fluid to be led at least partly under a level defined by a lower surface of the lid and/or under the side or peripheral sealing means, when present.

The invention also relates to a reservoir including a body and a lid as described in the present application, at least the $1^{st}$ chamber being closed sideways by the internal surface of the wall of the reservoir body. This wall separates the inside of the reservoir from the external atmosphere.

Such a reservoir can further include means for transferring ink, contained in the reservoir, to the $1^{st}$ duct of the lid.

The invention also relates to a continuous ink jet printer, including:

an ink circuit comprising a reservoir as described in the present application, for example as described above, a printing head, hydraulic connection means, for leading, from the ink reservoir on which the lid is deposited, an ink to be printed to the printing head.

The invention also relates to a continuous ink jet printer, including:

an ink circuit including a reservoir including a body and a lid as described in the present application, for example as described above, at least the $1^{st}$ chamber being closed, sideways, by the internal wall of the reservoir body, a printing head, hydraulic connection means, for leading, from the ink reservoir, an ink to be printed to the printing head, means for leading an ink to be recovered from the printing head to, depending on the embodiment, the $1^{st}$ duct or the $3^{rd}$ duct.

The invention also relates to a continuous ink jet printer, including:

an ink circuit including a reservoir including a body and a lid as described in the present application, of the type including a $1^{st}$ and a $2^{nd}$ duct, for example as described above, at least the $1^{st}$ chamber being closed, sideways, by the internal wall of the reservoir body, a printing head, hydraulic connection means, for leading, from the ink reservoir, an ink to be printed to the printing head, means for leading to the $1^{st}$ duct an ink recovered at the bottom of the reservoir and, to the $2^{nd}$ duct, an ink from an ink or solvent supply circuit from a solvent supply circuit.

The invention also relates to a continuous ink jet printer, including:

an ink circuit including a reservoir including a body and a lid as described in the present application, of the type including 3 ducts, for example as described above, at least the $1^{st}$ chamber being closed, sideways, by the internal wall of the reservoir body, a printing head, hydraulic connection means, for leading, from the ink reservoir, an ink to be printed to the printing head, means for leading:

- to the $1^{st}$ duct, an ink recovered at the bottom of the reservoir,
- to the $2^{nd}$ duct, an ink or a solvent from an ink or solvent supply circuit,
- to the $3^{rd}$ duct, an ink to be recovered from the printing head.

The invention also relates to a method for operating a continuous ink jet printer, of the type described in the present application, for example as described above, in which ink is recovered from the printing head and sent to the $1^{st}$ duct, and then in the $1^{st}$ chamber, this ink then flowing along the internal wall of the reservoir.

The invention also relates to a method for operating a continuous ink jet printer, of the type described in the present application, for example as described above, in which:

ink is recovered at the bottom of the reservoir and led into the $1^{st}$ duct, forming a $1^{st}$ ink flow in the $1^{st}$ chamber, ink or solvent is sent, by the ink supply circuit, into the $2^{nd}$ duct, forming a $2^{nd}$ fluid flow in the $1^{st}$ chamber, both flows being mixed with each other in said $1^{st}$ chamber, forming a mixture which flows along the internal wall of the reservoir.

The invention also relates to a method for operating a continuous ink jet printer, of the type described in the present application, for example as described above, in which:

ink is recovered at the bottom of the reservoir and led into the $1^{st}$ duct, forming a $1^{st}$ ink flow in the $1^{st}$ chamber, ink or solvent is sent, by the ink and/or solvent supply circuit, into the $2^{nd}$ duct, forming a $2^{nd}$ fluid flow in the $1^{st}$ chamber, both flows being mixed with each other in said $1^{st}$ chamber, forming a mixture which flows along the internal wall of the reservoir, ink being recovered from the printing head and sent to the $3^{rd}$ duct, and then in the $2^{nd}$ chamber, this ink then flowing along the internal wall of the reservoir.

DETAILED PRESENTATION OF EMBODIMENTS

Figure 4A:
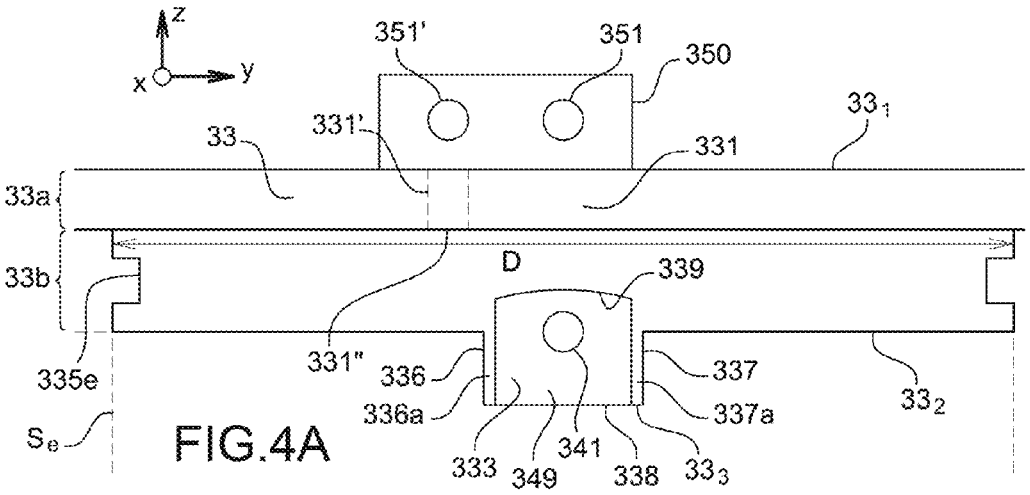
FIGS. 4A-4E represent an exemplary embodiment of a lid according to the invention.

FIG. 4A represents a side view of an exemplary embodiment of a lid 33 for a reservoir of a printer, for example of the type schematically represented in FIG. 7 or 8A-8B or 13.

This lid extends between an upper surface $\mathbf{33}_1$ and a lower surface $\mathbf{33}_2$. In the embodiment represented, both these surfaces are substantially parallel to each other and along a plane XY. By definition, the direction Z is the direction perpendicular to this plane.

Figure 4B:
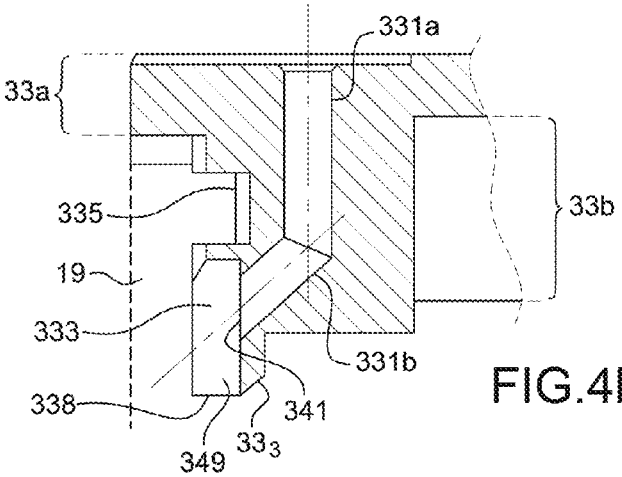
Figure 4C:
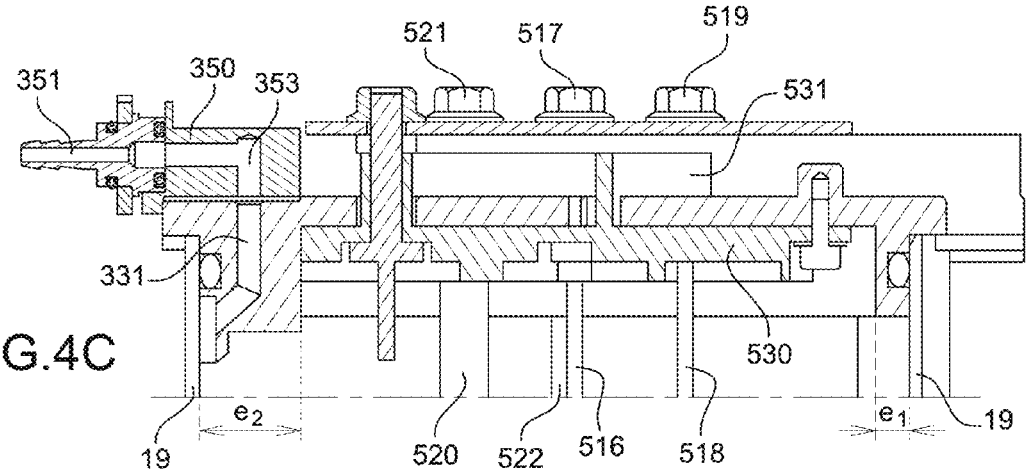

A first part 33*a*, called an upper part, bears against the top of the side wall(s) 19 of the reservoir (which separate inside the reservoir from the external atmosphere), as schematically represented in FIGS. 4B and 4C. This first part 33*a* has, in the plane XY, for example a substantially square or rectangular shape.

A second part 33*b*, called a lower part, has an external shape adapted to the internal shape of the reservoir that the lid will close. For example, this external shape is rectangular; alternatively it can be circular. In the latter case, this second part 33*b* has for example a circular ring shape, well seen in FIG. 6 (bottom view). It has external dimensions adapted to those of the internal shape of the reservoir; in the case of a circular shape, it has an external diameter D substantially equal to the internal diameter of the reservoir on which the lid is intended to be positioned to close it. Its side edge defines a part of a straight cylindrical surface $S_e$ or is part of a straight cylindrical surface $S_e$, which corresponds to the internal wall of the reservoir, when the latter is closed by the lid 33. A particular case is that of the cylindrical revolution surface, but, outside this particular case, are also included herein the straight cylinders, with a cross-section other than a circular one, for example a rectangular one. The cylindrical surface extends parallel to an axis Z, which will be the vertical axis when the lid is positioned on the reservoir. This second part is intended to be introduced into the upper part of the reservoir. It can advantageously include means for a sealing with the internal wall of the reservoir, for example a peripheral throat 335*e* which will allow to receive a seal.

A duct 331 passes through at least one part of the lid, it is preferably positioned in a part close to the external edge thereof. This duct enables a fluid to be led from the upper part 33*a* of the lid to the surface $S_e$, in fact to the internal wall of the reservoir when the lid 33 is in a position on the same. The fluid is flown under the action of the pump of the circuit in which it flows, but also under the action of gravity. According to the embodiment illustrated, it includes a first part 331*a*, which extends along a direction substantially perpendicular to the plane XY of the lid (or parallel to the surface $S_e$ or to the axis Z). This first part is extended by a second part 331*b*, which forms a bend with the first part. The duct 331 opens into a chamber, or cavity, 333, through an aperture 341. This chamber 333 can be made in a portion $\mathbf{33}_3$. In the embodiment illustrated, the latter partly projects from the lower part 33*b* of the lid. This portion is an extension of the circular ring 33*b*, under the lower surface $\mathbf{33}_2$, on a part of its periphery. Further, this cavity, which faces the surface $S_e$, is intended to face the internal surface of the wall 19, when the lid 33 is installed on top of the reservoir. This arrangement is represented in FIGS. 4B and 4C. An alternative is explained below in connection with FIG. 4E.

The chamber 333 is delimited by an internal surface, which includes, in the embodiment illustrated, side walls 336, 337, the front face 336*a*, 337*a* of which is substantially in the surface $S_e$ and comes against, or bears against, the internal surface of the wall of the reservoir when the same is closed by the lid 33; these front faces 336*a*, 337*a* advantageously have a curvature which corresponds to the inner surface of the reservoir. The chamber is thus open into, or onto, the surface $S_e$ or the internal wall of the reservoir which will close it sideways. A flat seal (not represented in the figures) can possibly be disposed between these front faces 336*a*, 337*a* and the inner surface of the reservoir. A wall 349, in which the aperture 341 is made, delimits the bottom of the cavity by facing the surface $S_e$ (and the internal wall of the reservoir when the same is closed by the lid 33).

The chamber 333 also includes, in its lower part, flowing means 338, for example by means of a slot or at least an outlet port. According to one embodiment, these means face an upper wall 339 of the chamber. These flowing means will enable the fluid, which has penetrated the chamber 333, to flow along the inner surface of the wall 19. Preferably, these flowing means offer the fluid a surface area higher than or equal to the surface area of the port 341. This condition makes it possible to ensure that the chamber 333 does not enable liquid to be retained, which would result in slowing flowing of this liquid to the reservoir.

The duct 331 enables the liquid to be directed to the surface $S_e$ and to the internal or inner surface of the reservoir when the same is closed by the lid 33, preferably under the sealing means 335*e* when the same are present and/or at least partly under a level defined by the lower surface of the lid (the plane XY for example). The chamber 333 enables the liquid that will be directed against the internal wall to be contained and then, through its outlet means, to be guided to the bottom of the reservoir (or along a direction opposite to the upper surface $\mathbf{33}_1$).

The cavity 333 has advantageously a sufficiently high volume not to be saturated and for the fluid not to overflow sideways. In practice, a volume between 50 $mm^3$ and 1000 $mm^3$ can be suitable. By way of indicating purposes, the reservoir volume is for example between 0.5 l and 10 l.

Figure 6:
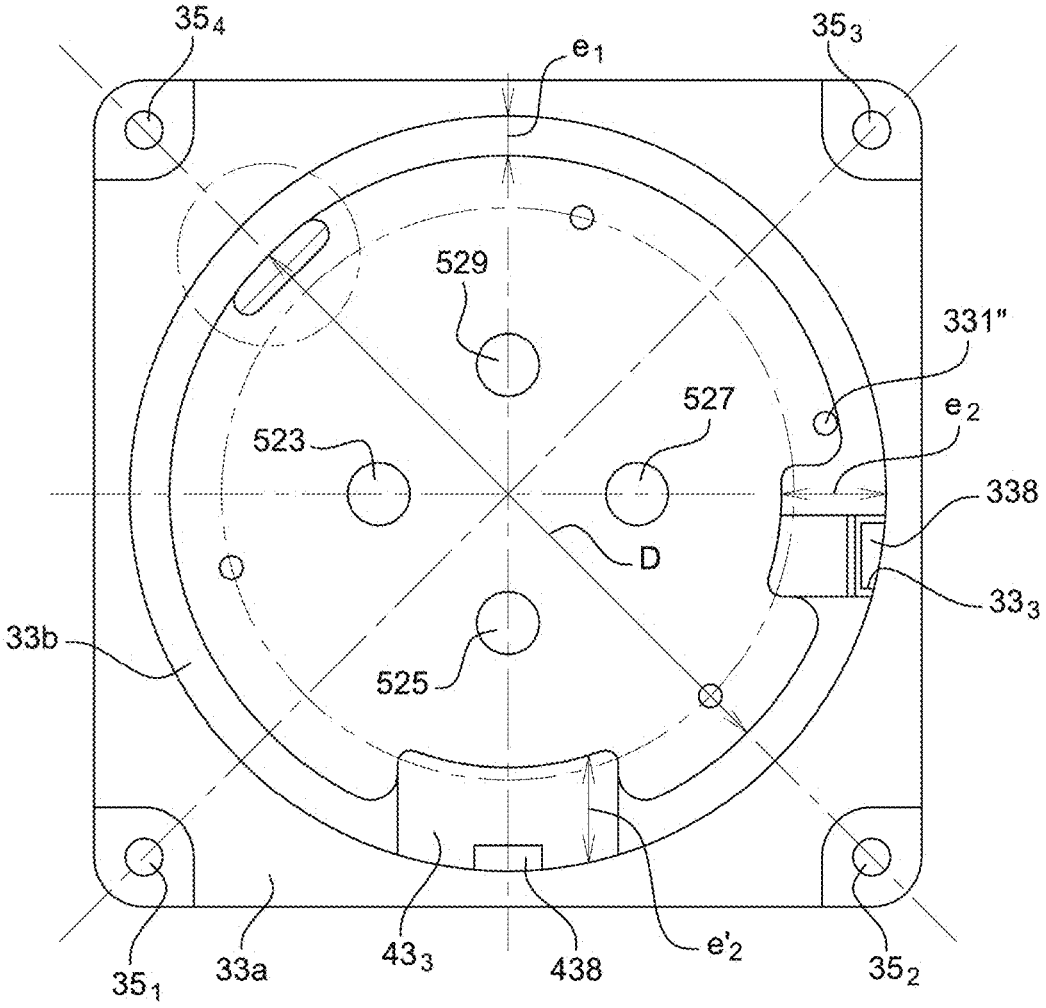
FIG. 6 represents a top view of another exemplary embodiment of a lid according to the invention.

In the zone in which the duct 331 is made, the second part 33*b* of the lid 33 can have a local extra thickness, which extends perpendicular to the surface $S_e$. In FIGS. 4C and 6, is seen the thickness $e_1$ of this part 33*b*, which is lower than the thickness $e_2$ of the part in which the duct 331 is made.

Preferably, the duct 331 leads the fluid to the cavity 333 along a direction tilted to the means 338. This tilt is a compromise between not spattering (or splashing) the wall and the requirement to limit the length of the duct (and thus the material necessary to be worked to make it).

For example this tilt is about 45° with respect to the plane XY (or with respect to the surface Se or to the axis Z) or, more generally, of an angle between 30° and 60° (with respect to the plane XY or with respect to the surface Se or to the axis Z). Thus, in the embodiment illustrated, the second part 331*b* of the channels which lead the fluid to the cavity 333 is tilted, for example by an angle of about 45°.

Figure 4D:
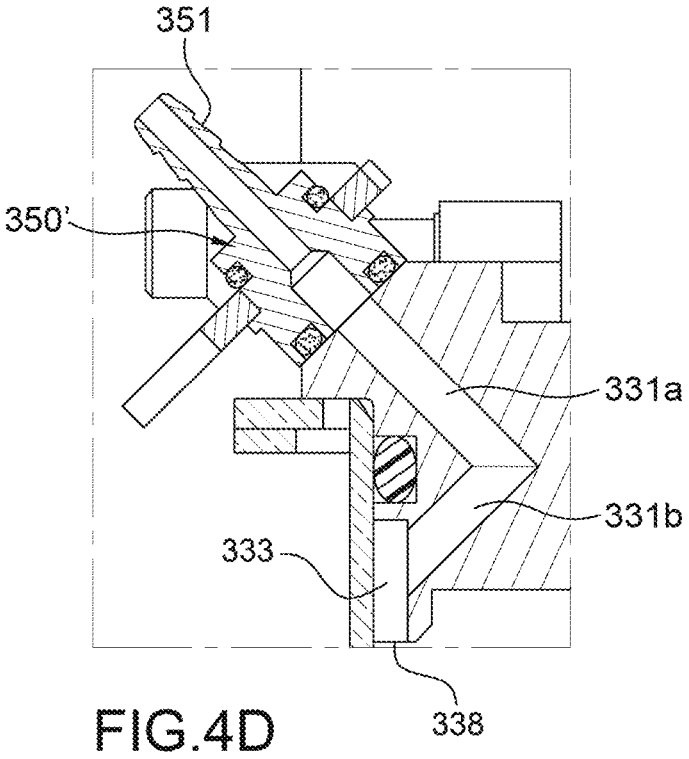

An alternative, also covered by the invention, is represented in FIG. 4D, in which the first part 331*a* of the duct forms, with respect to the plane XY, an angle different from 90°, (or is not parallel to the surface Se or to the axis Z) for example an angle of 45°. If the second part 331*b* is itself tilted by about 45° with respect to the plane XY (or with respect to the surface Se or to the axis Z), then both these parts form, between them, an angle of about 90°. The accessibility is promoted in the configuration of FIG. 4B, with the use of a connector 350 which affords a horizontal access.

After it has outflown through the means 338, the fluid flows along the inner surface of the wall 19: thereby, it can neither create spatters (which could happen if fluid drops were released on the surface of the liquid contained in the reservoir) nor disturb possible measurements, for example level measurements, which would be made inside the reservoir. This is in particular the case when the level measuring sticks 516-522 are provided, as illustrated in FIG. 4C. When the fluid is ink which comes from the printing head of a CIJ printer, the wall allow to spread the ink on the internal surface of the side wall of the reservoir, which will result in spreading the ink on the one hand, and the air bubbles on the other hand, which bubbles can be contained in this liquid, because of the mixing undergone by the ink, with air, upon sucking in the recovery gutter.

An interface or connection element 350 can be disposed on the upper part $\mathbf{33}_1$ of the lid, to connect an external duct to the duct 331. In FIG. 4C, is represented a cross-section view of such an element 350 and it can be seen in a front view in FIG. 4A. This element enables a fluid inlet 351 (as, for example, a «fir tree» connector) to be brought in communication with the duct 331. It has therethrough a duct 353 which includes two parts, which form, between them, an angle of about 90°. This makes it possible to have an inlet 351 arranged in parallel to the plane XY (or perpendicular to Se), which is favourable from the overall space point of view, along a vertical direction (or along the axis Z) of the entire device. In the case of the embodiment of FIG. 4D, the connection element 350' is represented in the same figure. It provides an access at an angle of about 45° with respect to the plane XY or to the surface Se.

As illustrated in FIG. 4A, a second duct 331' can be disposed parallel to the duct 331, this duct 331' passing through the upper part 33*a* of the lid and opening directly into inside the reservoir through a port 331" (see FIG. 6): it does not require to be extended, inside the reservoir, by another duct, because it simply affords putting the atmosphere located above the liquid present in the reservoir to atmospheric pressure. The interface element 350 can be adapted to connect the inlets of both ducts 331, 331' to inlets 351, 351', as is illustrated in FIG. 4A.

Figure 4E:
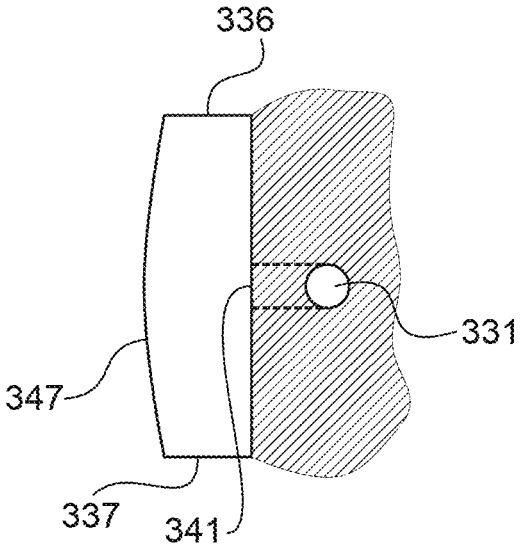

In FIG. 4E (in a bottom view) is represented the case where the cavity 333 is closed by a wall 347 (which faces the wall into which the port 341 opens) which itself bears against the internal surface of the side wall of the reservoir. This wall 347 advantageously has a curvature which corresponds to the internal surface of the reservoir. Its thickness is in the order of several tenths of mm, for example between 0.2 and 1 mm. A surface of this wall can thus be substantially the same as the surface Se. The fluid, which outflows from the duct 331, is thus directed, in a $1^{st}$ time to the internal surface of this wall and to the surface Se (and then to the internal surface of the wall of the reservoir when the lid is mounted thereto). And then, it flows against the internal surface of the internal wall of the reservoir, with the same effects as described above.

Figure 2:
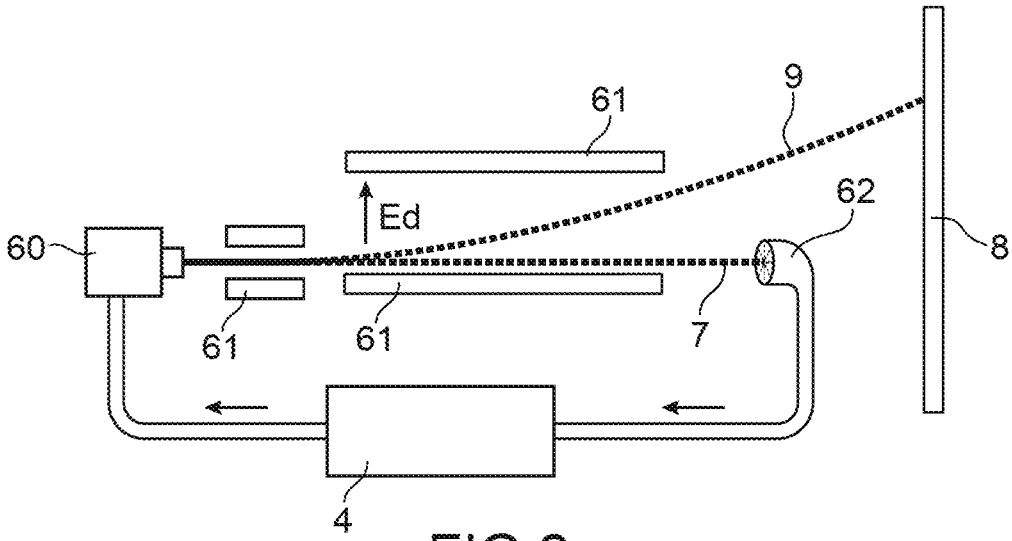
FIG. 2 shows a known structure of a print head of a CIJ type printer.
Figure 3A:
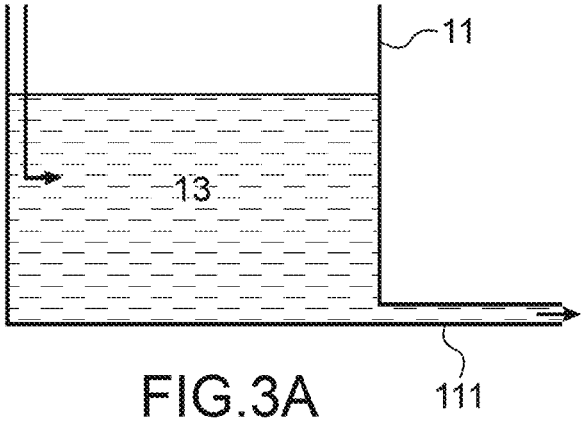
FIGS. 3A-3C illustrate solutions for supplying a reservoir.
Figure 3B:
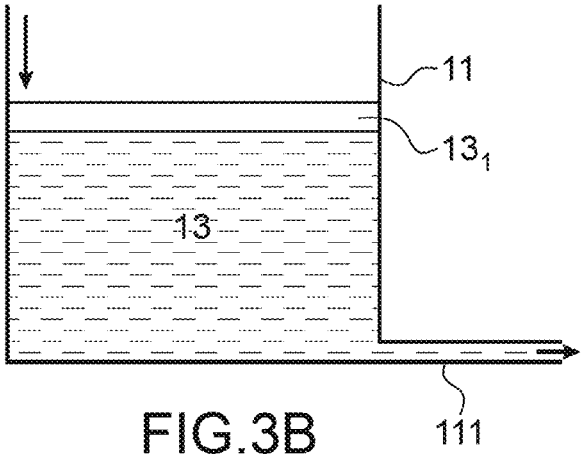
Figure 3C:
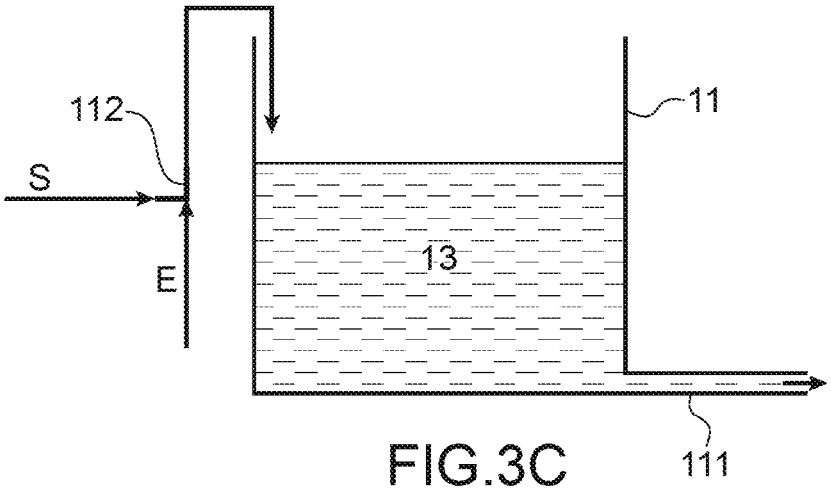

The means that have been described above in connection with FIGS. 4A-4E enable for example ink that comes back from the printing head to be brought into the reservoir, via the gutter 62 (see FIG. 2).

Figure 5A:
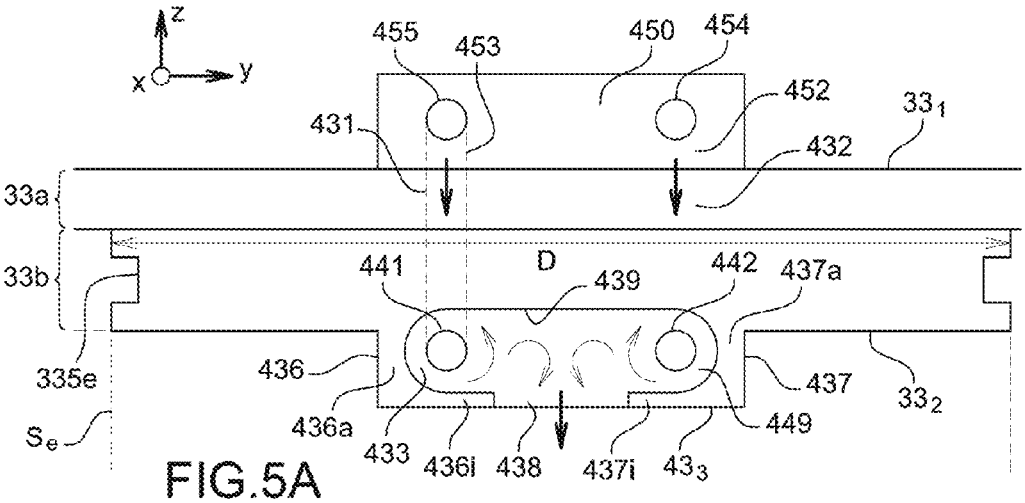
FIGS. 5A-5E represent another exemplary embodiment of a lid according to the invention.

FIG. 5A represents another exemplary embodiment of a lid 33. Common references to those of the preceding figures designate the same elements.

Ducts 431, 432 pass through the lid, preferably in a part close to the edge thereof.

Figure 5B:
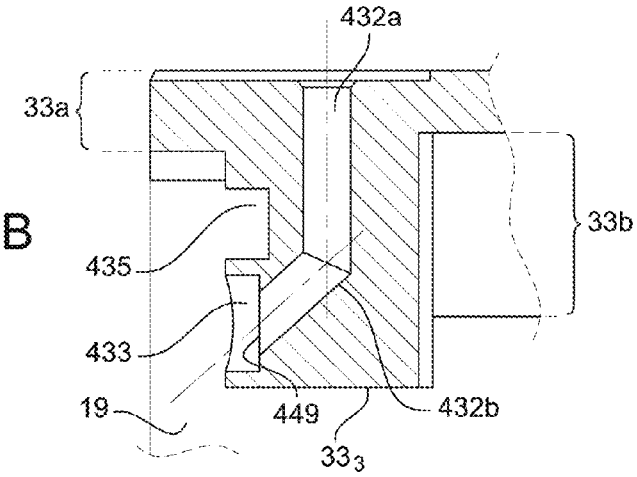
Figure 5C:
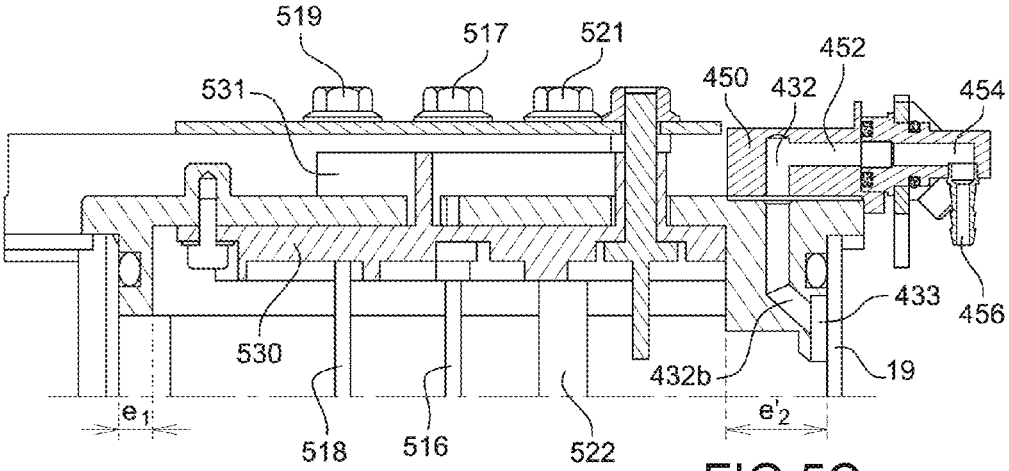

These ducts enable fluids, in particular liquids, to be led from the upper part 33*a* of the lid to the surface $S_e$, in fact to the internal surface of the wall of the reservoir when the lid 33 is in a position on the same. The fluids flow under the action of the pump of the circuit in which they circulate, but also under the action of gravity. These ducts are substantially parallel to each other and, according to the embodiment illustrated, include a first part 431*a*, 432*a*, which extends along a direction substantially perpendicular to the plane XY of the lid (or parallel to the surface $S_e$ or to the axis Z). Each of these first parts is extended by a second part 431*b*, 432*b*, which forms a bend with the first part. Each of these ducts 431, 432 opens into a chamber, or cavity, 433, called a mixing chamber or cavity, through an open aperture 441, 442. This chamber can be made in a portion $\mathbf{43}_3$. In the embodiment illustrated, this latter projects from the lower part 33*b* of the lid. This portion is an extension of the circular ring 33*b*, under the lower surface $\mathbf{33}_2$, on a part of its periphery. Further, this cavity is intended to face the wall 19, when the lid 33 is installed on top of the reservoir. This arrangement is represented in FIGS. 5B and 5C. An alternative is explained below in connection with FIG. 5E.

This chamber 433 is delimited by an internal surface which includes, in the embodiment illustrated, side walls 436, 437, the front face 436*a*, 437*a* of which is substantially in the surface $S_e$ and bears against the internal surface of the wall of the reservoir when the same is closed by the lid 33; these front faces 436*a*, 437*a* advantageously have a curvature which corresponds to the internal surface of the reservoir.

The chamber is thus open into, or onto, the surface $S_e$ or the internal wall of the reservoir which will close it sideways. A flat seal (not represented in the figures) can possibly be disposed between the front faces 436*a*, 437*a* and the internal surface of the reservoir.

A wall 449, in which each aperture 441, 442 is made, delimits the bottom of the cavity by facing the surface $S_e$ (and the inner wall of the reservoir when the same is closed by the lid 33).

The chamber 433 also includes in its lower part, flowing means 438, for example at least one slot or at least one outlet port. According to one embodiment, these means face an upper wall 439 of the chamber, which can be substantially parallel to the plane XY or perpendicular to the surface Se or to the axis Z. These flowing means will enable the liquid, which has undergone mixing in the cavity 433, to flow along the internal surface of the wall 19. Preferably, these flowing means offer the fluid a surface area higher than or equal to the sum of the surface areas of each of the ports 441, 442. This condition makes it possible to ensure that the cavity 433, if it provides a mixing function, does not yet enable liquid to be retained, which would result in slowing flowing the mixture intended to the reservoir. These means 438 can be limited, sideways, by portions 436*i*, 437*i* which are extensions of the side walls 436, 437 substantially in parallel to the plane of XY.

These portions 436*i*, 437*i* indeed form a lower wall of the cavity, this lower wall being provided with the means 438.

The ducts 431, 432 enable the liquids to be directed to the surface $S_e$ and to the internal surface of the wall of the reservoir when the same is closed by the lid 33, preferably under the sealing means 335*e* when the same are present and/or at least partly under a level defined by the lower surface of the lid (the plane XY for example). The chamber 433 enables these liquids directed to the internal surface of the wall to be mixed, to be temporarily contained therein and then, by its outlet means, to guide the mixture to the bottom of the reservoir (or along a direction opposite to the upper surface $\mathbf{33}_1$).

The cavity 433 has advantageously, on the one hand, a sufficiently low volume for the fluid coming through the ports 441, 442 to be efficiently mixed therein. But it has also, on the other hand, a sufficiently high volume not to create too much head loss on the path of the mixture in question. Indeed, it is preferred that a liquid, for example an ink mixture added from a cartridge and ink that comes from a recirculation from the reservoir bottom, arrives as quickly as possible in the liquid contained in the reservoir, or in any case without the fluid circuit it will have to travel slowing it down too much. In practice, a volume between 70 $mm^3$ and 2000 $mm^3$ can be suitable.

In the cavity 433 of FIG. 5A, curved arrows are represented which correspond to turbulences and/or turbulent motions that the fluids undergo when they are in the cavity. These turbulent motions make it possible to ensure mixing of both liquids which arrive from the 2 ducts or channels 431, 432.

In the zone in which the ducts 431, 432 are made, the second part 33*b* of the lid 33 can have a local extra thickness, which extends perpendicular to the surface $S_e$. It is seen, in FIGS. 5C and 6, the thickness $e_1$ of this part 33*b*, which is lower than the thickness $e'_2$ of the part in which the ducts 431, 432 are made.

Preferably, the ducts 431, 432 lead the liquids in the cavity 433 with a tilt, to the means 438. This tilt is a compromise between not spattering the wall and the requirement to limit the length of the duct (and thus the material necessary to be worked to make it). For example, this tilt is about 45° with respect to the plane XY (or with respect to the surface Se or to the axis Z) or, more generally, of an angle between 30° and 60° (with respect to the plane XY or with respect to the surface Se or to the axis Z). Thus, in the embodiment illustrated, the second part 431*b*, 432*b* of the channels which lead the fluids to the cavity 433 is tilted, for example by an angle of about 45°.

Figure 5D:
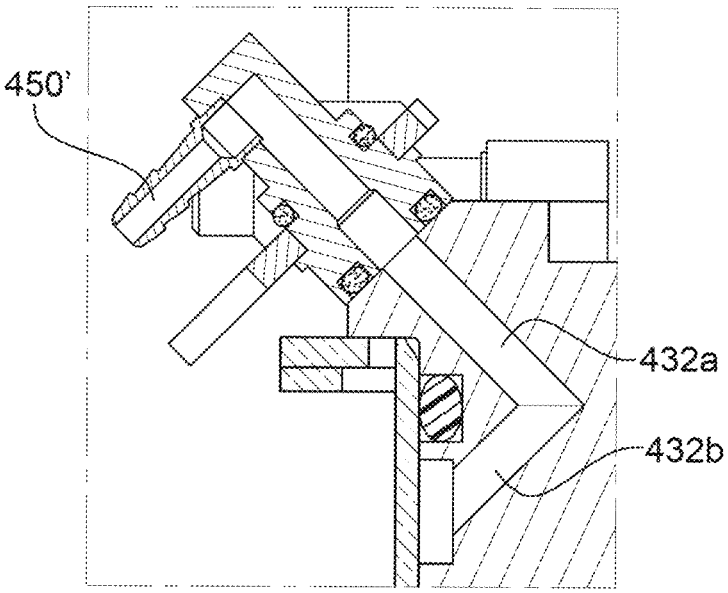

An alternative, also covered by the invention, is represented in FIG. 5D, in which the first part 432*a* of the duct forms, with respect to the plane XY, an angle different from 90°, for example an angle of 45°. If the second part 432*b* is itself tilted by about 45° with respect to the plane XY (or with respect to the surface Se), then both these parts form, between them, an angle of about 90°.

After it outflows through the means 438, the fluid mixture flows along the internal surface of the wall 19: therefore, it can create neither spatters (which could happen if liquid drops were released on the surface of the liquid contained in the reservoir) nor disturb possible measurements, for example level measurements, which would be made inside the reservoir. This is in particular the case when the level measuring sticks 516-522 are provided, as illustrated in FIG. 5C.

An interface or connection element 450 can be disposed on the upper part $\mathbf{33}_1$ of the lid, to connect 2 external ducts to the ducts 431, 432. In FIGS. 5C and 5A, are respectively represented, a cross-section and a front view of such an element 450. This element enables fluid inlets 454, respectively 455 (each as, for example, a "hose barb" connector) to be brought in communication with the duct 432, respectively 431. There are 2 ducts 452, 455 therethrough, each including two parts, which form, between them, an angle of about 90°. This makes it possible to have inlets 450, 455 disposed in parallel to the plane XY (or perpendicularly to Se), which is favourable from the accessibility point of view, along a vertical direction (or along the axis Z) of the entire device. In the representation of the FIG. 5C, the inlet 454 is extended by a second connection 456, directed downwardly from the reservoir, which enables an ink flow, which is pumped in the bottom of the reservoir, to be led to this inlet 454 in order to make up a recirculation flow.

In the case of the embodiment of FIG. 5D, the connection element 450' is represented on this same figure. It provides an access along an angle of about 45° with respect to the plane XY or to the surface Se.

Figure 5E:
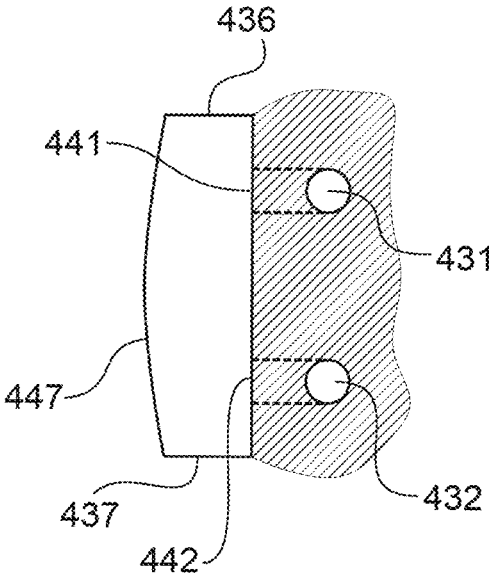

In FIG. 5E (in a bottom view) is represented the case where the cavity 433 is closed by a wall 447 (which faces the wall into which the port 341 opens) which itself bears against the internal wall of the reservoir. This wall 447 advantageously has a curvature which corresponds to the internal surface of the reservoir. Its thickness is for example between 0.2 and 1 mm. This wall is substantially the same as the surface Se. The fluids, which outflow from the ducts 431, 432 are thus directed, in a $1^{st}$ time to this wall and to the surface Se (and to the wall of the reservoir when the lid is mounted thereon). Then, their mixture can flow against the internal wall of the reservoir.

The means that have been described above in connection with FIGS. 5A-5E enable for example an ink mixture to be led to the reservoir, which comes from the bottom of the reservoir, by recirculation, and ink, or respectively solvent, which comes from an ink cartridge, respectively from a solvent cartridge. The chamber 433, as has been described above, enables mixing of both these liquids to be made before the mixture is able to flow against the internal surface of the wall of the reservoir, to the liquid pool already contained therein.

Both aspects that have been presented above can be combined in a same reservoir lid. Thus, in FIG. 6, is represented a bottom view of a lid which includes a chamber 333 as described above in connection with FIGS. 4A-4E and a chamber 433 as described above in connection with FIGS. 5A-5E. Identical references to those of the preceding figures designate the same elements.

In this figure, it is seen that the duct 331' opens, through an aperture or port 331", into a cavity formed or delimited by the lower part 33*b*.

It is also seen in this figure that, in each of the 4 angles of the upper part 33*a*, a port $\mathbf{35}_i$ (i=1-4) can be provided; these 4 ports will enable the entire lid to be attached to the upper part of the reservoir.

The lid can be provided with means for receiving one or more measuring sticks or rods for measuring the liquid level in the reservoir.

Thus, in FIGS. 4C and 5C, are seen 4 measuring sticks or rods 516, 518, 520, 522 which plunge into the reservoir and which pass through the upper part 33*a* of the lid 33. There are held by means 517, 519, 521 (the means for holding the stick 522 are not represented, because they are behind the means 517), for example nuts, each of which is screwed to a threaded portion which is an extension of each of the sticks. To enhance holding, insulating plates 530,531 can be provided on either side of the upper part 33*a* of the lid. These plates, as well as the upper part 33*a*, have ports which enable each of the sticks 516-522 to be inserted. The same elements are found in FIG. 5C.

The operation of all these measuring sticks will now be explained, in connection with FIG. 7, in which reference 19 designates again the reservoir wall.

In this figure, are represented 2 measuring sticks, or electrodes, 516, 518 and 2 reference sticks, 520, 522.

Each of the reference rods comprises an electrodes covered, on most of its length, with a coating, or a sleeve 524, 526, of a dielectric or electrically insulating material, which only allows an end portion of the corresponding electrode, having a length $l_R$, to project. Thus, it enables a liquid level to be measured with a depth $l_R$+p, p being the distance between the free end of the reference electrode and the bottom of the tank.

Each of the measuring rods 516, 518 includes an electrode which is, in turn, not covered with a sleeve, at least on the part which is included between the free end of the electrode, intended to be the closest to the bottom of the tank, and the maximum level $h_{max}$ desired to be measured. The different electrodes are of conducting material, for example of stainless steel.

The pairs of electrodes are fed with a current by generator means 530. The electrodes of each pair are electrically arranged in series with an electrical circuit connecting said electrodes in series. Preferably, the current supplied is an AC electric current, having a null mean to avoid any electrolysis.

Means 532, for example a voltage detector, enable a voltage $V_M$ between both measuring rods to be measured. For example, these means 532 include a resistor which enables both the intensity to be measured by the voltage measurement and the current to be limited in the circuit.

Preferably, these means enabling a measurement to be made perform a sampling on peak values, and then an amplification.

Means 534, such as multiplexing means, typically a multiplexer as used in electronics, can be provided to perform, alternatively, a measurement at the terminals of both measuring rods and a measurement at the terminals of both reference rods. Thus, the pair at the terminals of which no measurement is made is completely disconnected and has no influence on the measurement made at the terminals of the other pair, and any coupling effect of the electrode pairs is avoided. In this configuration, the same voltage measuring means 532 can be used for measuring a voltage $V_R$ between both measuring rods and for measuring a voltage $V_R$ between both reference rods.

For example, a measurement is performed during 100 ms with both measuring rods, and then during 100 ms with both reference rods. The measurement durations with both measuring rods and then both reference rods can be equal, or different: for example, the ratio of the measurement period with both measuring rods to the measurement period with both reference rods can be between 5 and 10.

From the voltage measurement $V_M$ and $V_R$, an impedance, a measurement impedance (or its resistive component) $R_M$ and a reference impedance $R_R$ (or its resistive component) can be deduced respectively.

Then, $R_R/R_M$ is calculated to deduce therefrom the level $h_M$ of the liquid height by the following formula:

$$h_M = K \cdot (R_R/R_M) - K_0$$

Thus, $R_R/R_M$ (the ratio of the resistive components) is preferably calculated to deduce the ink level therefrom. This formula is independent from the liquid conductivity which, as will be seen herein below, is confirmed by experimental measurements. Surprisingly, it has been noticed that the reference resistance, per mm of ink, is different from the measurement resistance, per mm of ink. (The difference probably comes from the non-direct field lines (that is those which are not perpendicular to the electrodes), which are not identical for the reference resistance and the measuring resistance, because of structure differences in the bottom of the electrodes).

Figure 7:
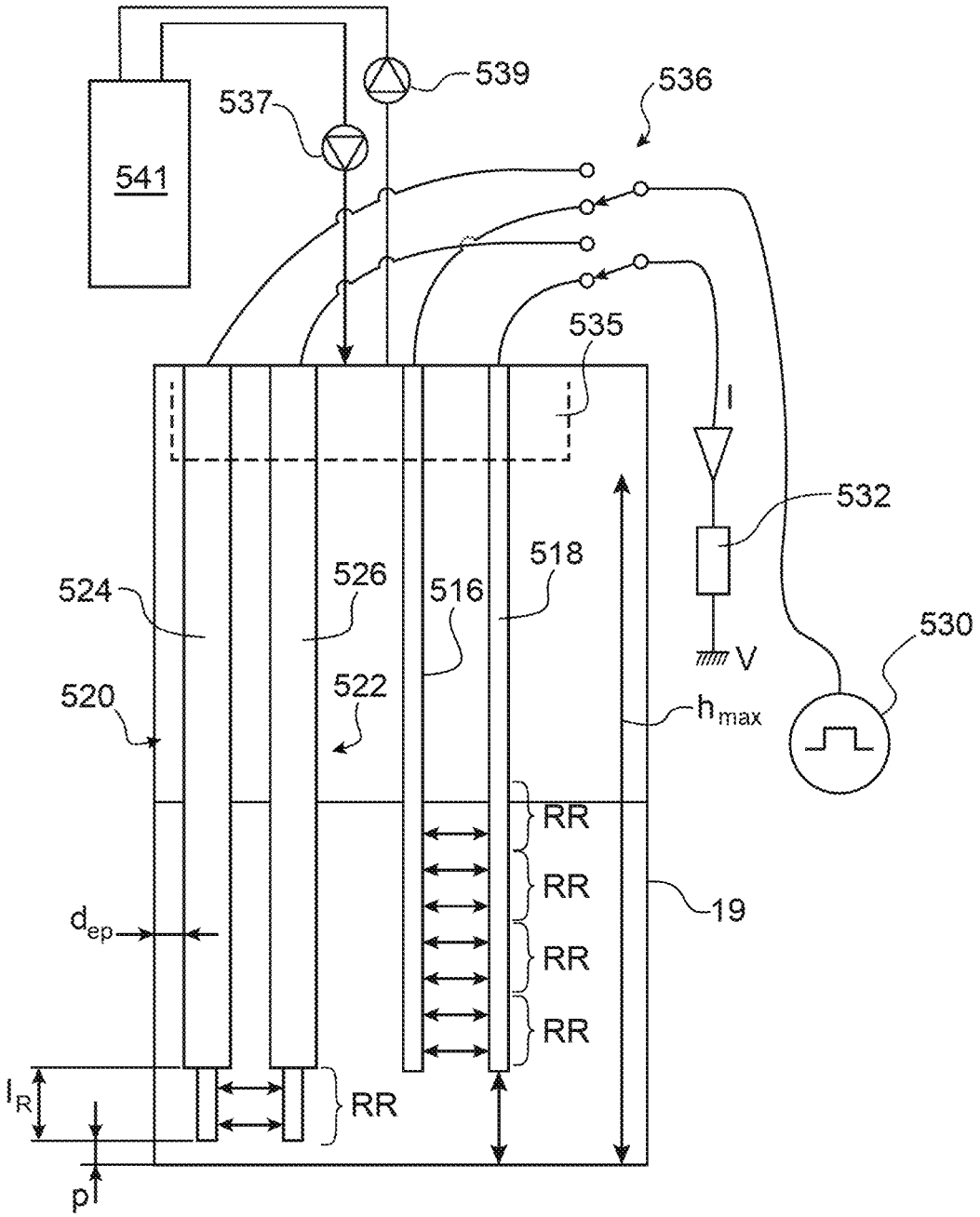
FIG. 7 illustrates the operation of measuring sticks in an ink reservoir of a CIJ type printer.

A correct measurement can be carried out as soon as the reference electrodes are fully dipped (this is in the case in FIG. 7) and/or the measurement electrodes of a distance p', with respect to the bottom of the tank, equal to p increased by a length corresponding to the active part of the reference electrodes (this is also the case in FIG. 7). This previous condition results in $p' \geq p + l_R$; p' is preferably equal or close to $p + l_R$. Alternatively the ends of the measurement electrodes can be protected by an insulating coating or insulating sleeves, having a length equal to or higher than the active part $l_R$ of the reference electrodes.

In the opposite case, the formula $h_M = K \cdot (R_R/R_M) - K_0$ is not valid in the bottom of the tank as long as the ends (over the distance $l_R$) of the reference electrodes are not fully dipped (in this case, the measurement and reference impedance are equal, which gives a constant hm value). But, once the reference electrodes are fully dipped, the above formula can then be applied, coefficients $K_0$ and $K_1$ being experimentally determined.

Electronic means can be programmed, for example in the printer controller, to calculate $h_M$ as a function of the $R_R$ and $R_M$ values. Measurement data are transmitted from the ink tank to the controller, which then carries out data processing and calculating the ink or liquid level.

If the ink level thus calculated is lower than a predetermined threshold level, the controller can trigger a tank filling operation.

If the ink level thus calculated is lower than a predetermined threshold level, the controller can trigger a reservoir filling operation.

It is understood that the implementation of the level measuring means by sticks or rods, directly in the reservoir, is a sensitive operation. In particular, such a measurement should not be disturbed by inopportune liquid flows, which would come from introducing, ink or solvent into the reservoir. A lid according to the invention enables, as explained above, the different liquids to be led to the reservoir wall, thus as far as possible from the level measuring sticks. Any disturbance of the same is thus avoided.

Even in the absence of the measuring sticks, holding an undisturbed ink level in the reservoir is to be favoured. In particular, this ink level should not be disturbed by inopportune liquid flows, which would come from introducing ink or solvent into the reservoir. A lid according to the invention enables, as explained above, the different liquids to be led to the reservoir wall, thus as far as possible from the level measuring sticks. Any disturbance of the ink level is thus avoided.

A lid according to the invention closes an ink reservoir. The $1^{st}$ and, possibly, the $2^{nd}$ chamber is/are closed sideways by the internal wall of the reservoir.

Figure 8A:
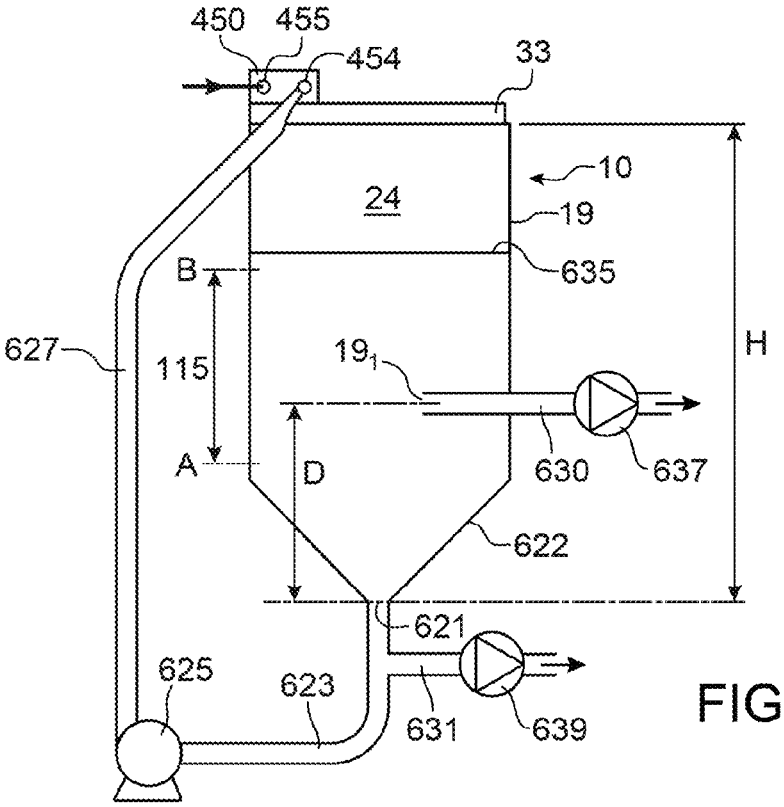
FIGS. 8A and 8B represent exemplary embodiments of a reservoir according to the invention, with a flow of the ink from the lower part of the reservoir to its upper part.

FIG. 8A shows an example embodiment of an ink reservoir 10 to which the invention can be applied, for an ink circuit of a continuous inkjet printer.

This reservoir 10 is delimited by one or more sidewall(s) 19 and covered with the cap or lid or cover 33, preferably according to one of the embodiments described above. The bottom 622 is preferably conical and has no horizontal surface or it has an extremely small horizontal surface, so as to accumulate the minimum amount of material. The tip of the cone is oriented towards the bottom of the device along the direction of liquid flow when the reservoir is placed vertically. To satisfy the condition for slip on an inclined surface, the cone angle from the horizontal is chosen such that it is greater than about 30° (and less than 60° or 80°), or less than about 60° (but more than 10° or 30°) from the vertical or the sedimentation direction of pigments.

The example of a part of the reservoir for which the wall is cone-shaped is given herein, but other forms are possible, for example a pyramid shaped wall or more generally a wall tapered or converging towards a portion that comprises an ink flow orifice. The section of the part thus delimited reduces towards this flow orifice.

Such a flow orifice or ink outlet 621 is made in an end part of the reservoir, particularly through the bottom end of the reservoir, in this case formed by the cone tip.

Starting from this outlet, a first pipe or duct 623 connects a pump 625 to said bottom end.

Preferably the pump 625 is located under a level that passes through the lower part of the reservoir or under this bottom part. This makes sure that it is always pressurised and primed. More generally, any device for displacement of ink from the bottom to the top of the reservoir can be used.

A second hose or duct 627 connects the output of the pump 625 to the inlet 454 of the interface means 450 disposed on the lid 33, as has already been described above (see for example FIG. 5A). The ink thus enters again the reservoir, at a point above the maximum ink level in the reservoir, thus above the surface 635 of the ink present in the reservoir, which is found, for example, 10 mm or 50 mm from the top of the reservoir (defined by the lower face $\mathbf{33}_2$ of the lid 33).

Preferably the pump 625 provides permanent ink circulation with a flow greater than or equal to the ink sedimentation velocity. The pump flow is for example between 10 l/hour and 20 l/hour, it is for example of about 14 l/hour. This circulation takes place along a single direction from the bottom of the reservoir to the upper part.

The pump may be a membrane pump type or a peristaltic pump or a geared pump or a centrifugal pump or any other type of pump.

Preferably, it is capable of reaching a flow greater than the pigment sedimentation velocity over the entire surface of the cylindrical part of the reservoir. For example, a flow of more than 0.5 $cm^3$/hour is sufficient for a reservoir for which the largest cross-sectional area is 50 $cm^2$.

Pumping is preferably done permanently, regardless of whether or not the printer is in operation. This possibility is available if the pump 625 is dedicated to the circulation of ink, and is not governed by the operating rate of another function.

The reservoir 10 is provided with means 630 and/or 631 to draw off ink in order to pressurise it and to send it to the print head. Each of these means may be composed of a duct connected to a pump 637, 639 respectively, so that ink can be sent under pressure to the print head.

This drawing off may be made at a minimum distance d from the bottom of the reservoir and the surface of the liquid in the reservoir, that may for example be calculated using Stokes' law as a function of the size grading of the largest ink pigment particles, the pigment density and the density of the dispersing medium:

$$v = \frac{2 \cdot r^2 g \Delta\rho}{9\eta} = \frac{d^2 g \Delta\rho}{18\eta}$$

where v is the sedimentation velocity in m/s, r is the radius, D is the diameter of particles in m, g is the gravitation constant 9.81 $m/s^2$, $\Delta\rho$ is the difference in density between the pigment and the liquid medium in $kg/m^3$, $\eta$ is the dynamic viscosity in Pa·s, and t is the time, where d=v·t, d is the distance from the lowest point of the reservoir.

A median zone 115 of the reservoir can be defined, for example located between:

a first level A, defined by the ink flow orifice or by a level located at not less than $1/20^{th}$ or $1/10^{th}$ or ¼ or ⅓ of the reservoir height, measured from its lowest point, as a proportion of the height H of the reservoir (itself measured between the lowest point in the reservoir and the highest point in the reservoir when the reservoir is in operation), and a second level B defined by the upper third or quarter (once again measured as a proportion of the height H of the reservoir as explained above). In this zone 115, the concentration of pigment in the ink remains approximately constant and equal to the initial nominal concentration.

One interesting point for the ink sampling point is approximately in the median zone 115 between the ink surface and the outlet orifice 621 located in the bottom of the reservoir. The distance D, measured along the vertical or the pigment sedimentation direction when the reservoir is in use, between the ink drawing off point and the orifice 621, is for example not less than 10 mm, or 20 mm, or 50 mm. The position of this drawing off point $\mathbf{19}_1$ is preferably vertically in line with the orifice 621. It can be determined as a function of physical parameters of the ink (particularly pigment size grading, pigment density, density of the dispersing medium), as explained above. The drawing off location is the location at which pigment concentration will remain nominal or approximately constant, preferably for as long as possible when recycling is not present.

Therefore, we chose a fixed drawing off point in order to maximise the recycling stop time as a function of the machine usage.

With a drawing-off point $\mathbf{19}_1$ positioned such as described above, drawing off may be made at any time without waiting for the recirculation between the bottom of the reservoir and the surface to homogenize the ink over the entire height of the liquid, after the printer is restarted after a rest period. In this way, the printer may be put into operation without delay, at least with a much shorter time than in previous embodiments.

Furthermore or as a variant, ink may be drawn off from the recirculation duct 623 at the bottom of the reservoir to supply the head under pressure. To achieve this, means 631 are used to draw off liquid from this duct. Drawing off from the duct 623 can feed the print head even when the ink level in the reservoir is located below means $\mathbf{19}_1$, if there are any.

A device according to the invention can include either and/or both of the drawing off means 630, 631, each with the respective advantages indicated above.

Figure 8B:
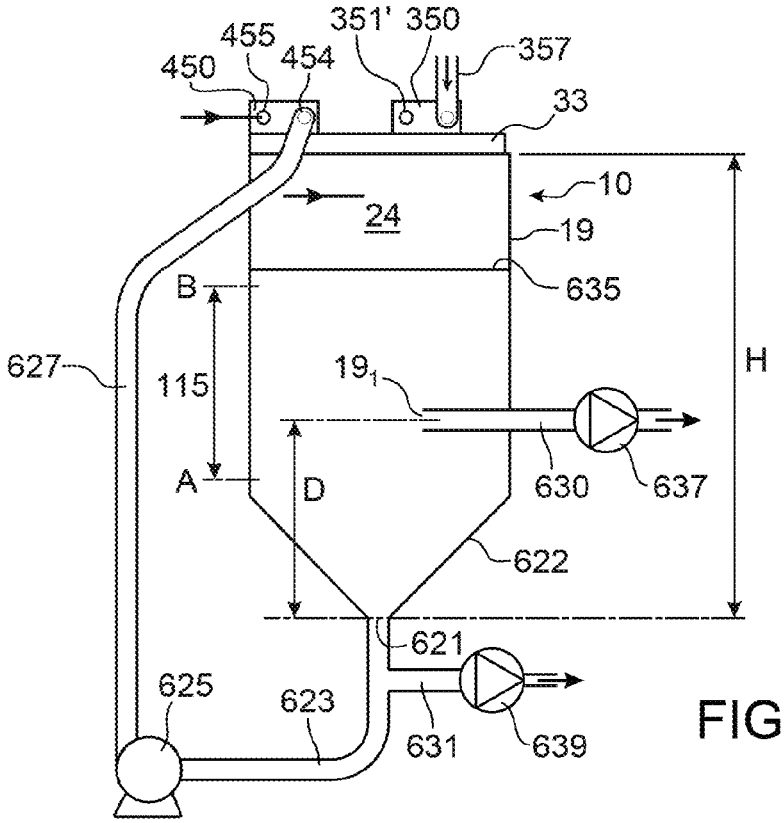

FIG. 8B is another exemplary embodiment of an ink reservoir to which the invention can be applied, for an ink circuit of a continuous ink jet printer, the lid 33 having also available means, described above in connection with FIGS. 4A-4E, to recover the ink that comes from the printing head. The reservoir illustrated in this figure includes the means that have already been described above in connection with FIG. 7A, but it also includes interface means 350 disposed on the cover 33, as has already been described above (see for example FIG. 4A). A hose or duct 357 leads the ink at the outlet of the gutter 62 to the inlet 351. This recovered ink thus enters again the reservoir, also at a point above the maximum ink level in the reservoir, thus above the surface 35 of the ink present in the reservoir.

The lids 33 of FIGS. 8A, 8B can be provided with measuring sticks or rods, as explained above in connection with FIG. 7.

Figure 1:
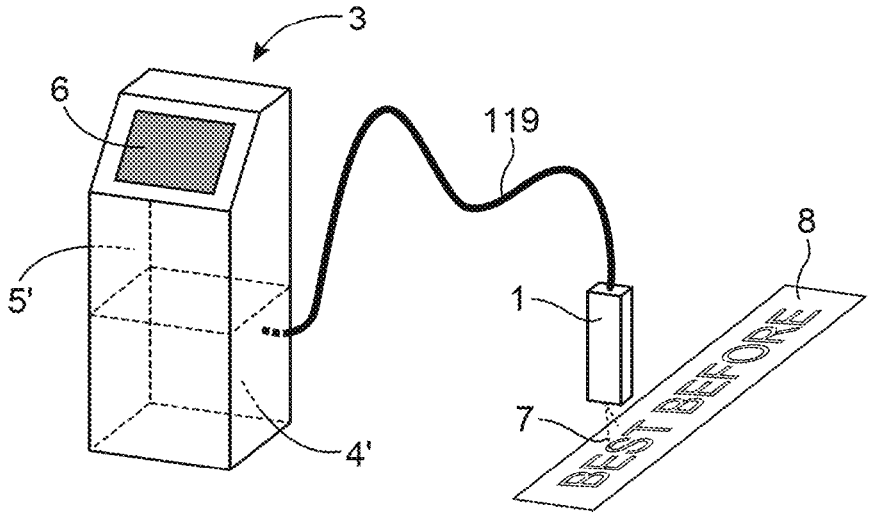
FIG. 1 shows a known printer structure.

A continuous ink jet printer according to the invention can include:

an ink circuit including at least one reservoir according to the invention, a printing head 1 (FIGS. 1 and 2), hydraulic connection means 119, for leading, from the ink reservoir, an ink to be printed to the printing head.

Electrical connection means are on the other hand provided to electrically supply the printer.

Drawing off the ink in the bottom of the reservoir and moving it or bringing it back to the top of the reservoir, using the lid according to the invention, even with an extremely low flow rate, is sufficient to keep homogeneity of the ink in the entire reservoir. This represents a particularly interesting economy as regard means accordingly.

On the other hand, solid particles settle more quickly by sliding on a tilted surface as in a liquid, if the angle of the tilted surface with respect to the horizontal is higher than the sliding angle of the particles.

These considerations are applied to the embodiments described below.

Figure 9:
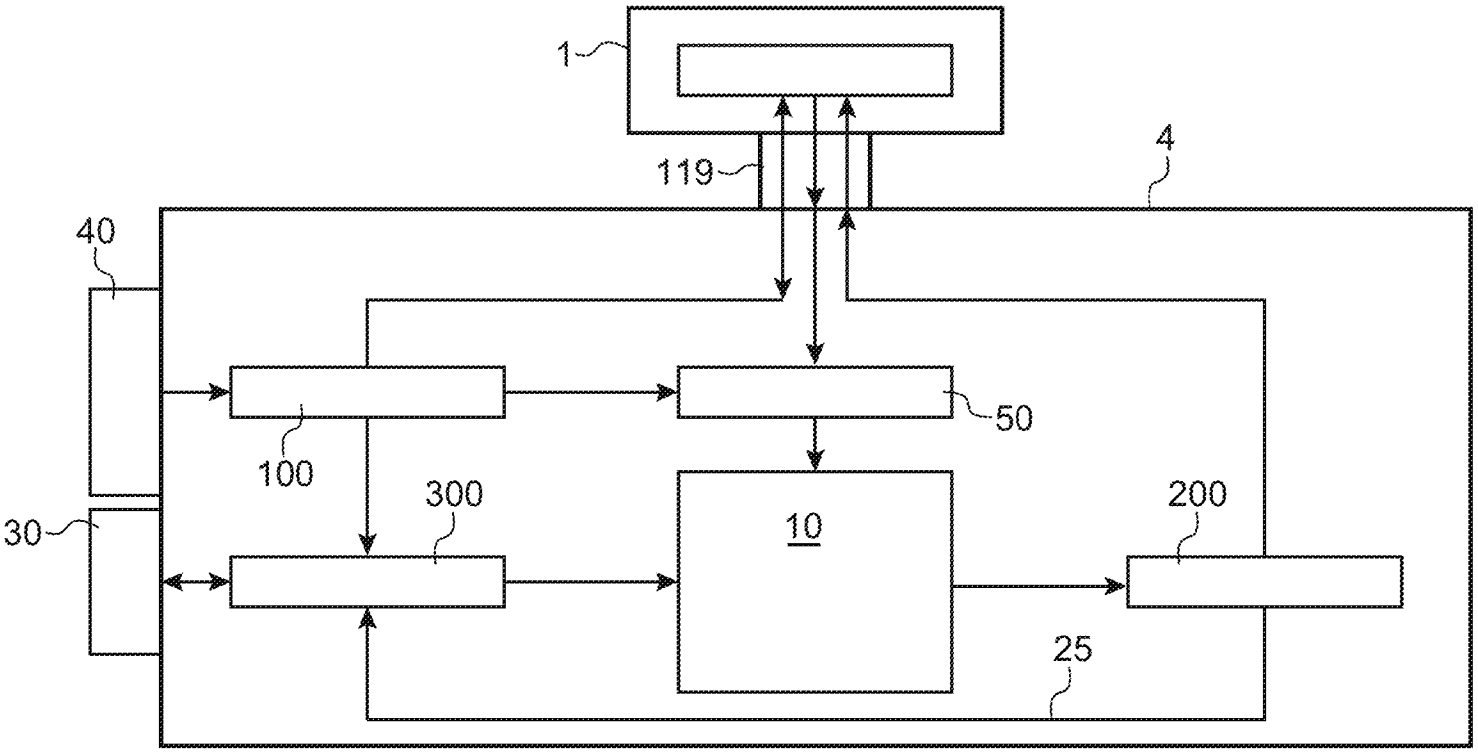
FIGS. 9 to 13 represent aspects of a circuit of a CIJ type printer to which the invention can be applied.

An example of an architecture of a fluid circuit of a printer to which the invention can be applied is shown in FIG. 9. Reference identical to those used previously denote identical or corresponding elements. In particular, the flexible umbilical 119 is shown that contains hydraulic and electrical connections and the print head 1, to which the printer architecture disclosed below can be connected.

This FIG. 9 shows that the fluid circuit 4 of the printer comprises a plurality of means 10, 50, 100, 200, 300, each means being associated with a specific function.

A removable ink cartridge 30 and a solvent cartridge 40 that is also removable are associated with this circuit 4. Although the presence of cartridges can be recommended, including when the ink circuit is stopped (for example to enable active monitoring), the ink circuit may be without the cartridges 30, 40 when stopped or at rest.

Reference 10 refers to the main reservoir that contains a mix of solvent and ink.

Reference 100 (or solvent supply circuit) refers to all means that are used to draw off and possibly store solvent from a solvent cartridge 40 and to supply solvent thus drawn off to other parts of the printer, either to supply the main reservoir 10 with solvent, or to clean or maintain one or several of the other parts of the machine.

Reference 300 (or ink supply circuit) refers to all means of drawing off ink from an ink cartridge 30 and supplying the ink thus drawn off to supply the main reservoir 10. As can be seen on this figure, according to the embodiment disclosed herein, these means 300 can be used to send solvent from means 100 to the main reservoir 10.

Reference 200 (or ink pressurization circuit) denotes all means used to draw off ink from the main reservoir 10 and for sending it to print head 1. According to one embodiment illustrated here by arrow 25, it is also possible that these means 200 can be used to send ink to the means 300, and then once again to the reservoir 10 which enables ink flow recirculation inside the circuit. This circuit 200 may also allow draining the reservoir in the cartridge 30 as well as cleaning of the connections of the cartridge 30 (in the case of the embodiment in FIG. 12, by changing the position of the valve 37).

The system shown on this figure also comprises means 50 of recovering fluids (ink and/or solvent) that returns from the print head, more precisely from the gutter 62 of the print head or from the head rinsing circuit. Therefore these means 50 are arranged on the downstream side of the umbilical 119 (relative to the flow direction of fluids returning from the print head).

As can be seen on FIG. 9, the means 100 may also allow sending solvent directly to these means 50 without passing through the umbilical 119 or the print head 1 or the recovery gutter 62.

The means 100 may comprise at least three parallel solvent supplies, one to the head 1, the $2^{nd}$ to means 50 and the $3^{rd}$ to means 300.

Each of the means described above can be provided with means such as valves, preferably solenoid valves, for guiding the fluid concerned to the chosen destination. Thus, means 100 can be used to send solvent exclusively to head 1, or exclusively to means 50 or exclusively to means 300.

In a variant, the same means may enable sending solvent toward all means forming part of the ink circuit, for example for a complete rinsing of the entire circuit.

Each of the means 50, 100, 200, 300 described above can be provided with a pump that is used to process the fluid concerned (the $1^{st}$ pump, $2^{nd}$ pump, $3^{rd}$ pump, $4^{th}$ pump respectively). These various pumps perform different functions (the functions of their corresponding means) and are therefore different from each other, although these different pumps may be of the same type or a similar type (in other words, none of these pumps performs 2 of these functions).

The means 20 make it possible to ensure recirculation (they play the role of the pump 625 of FIGS. 8A, 8B).

In particular, the means 50 comprise a pump ($1^{st}$ pump) that pumps recovered fluid as described above, from the print head, and sends it to the main reservoir 10. This pump is dedicated to recovery of this fluid from the print head and is physically different from the $4^{th}$ pump of means 300 dedicated to transfer of the ink and/or from the $3^{rd}$ pump of means 200 dedicated to pressurisation of the ink at the outlet from reservoir 10.

The means 100 comprise a pump ($2^{nd}$ pump) that pumps solvent and sends it to means 50 and/or to means 300 and/or to the print head 1.

Figure 10:
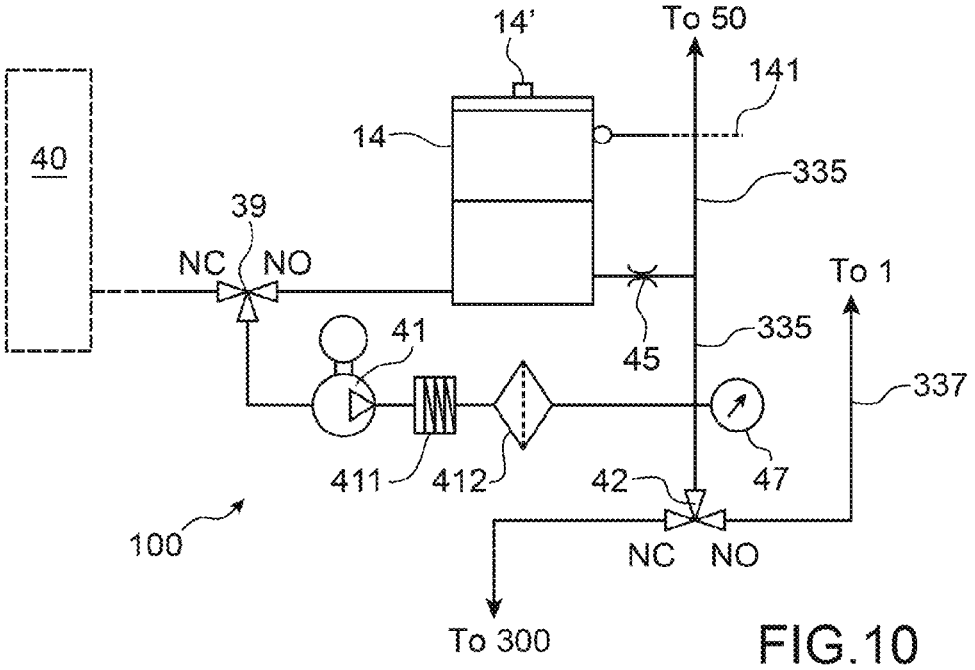

FIG. 10 shows an even more detailed representation of means 100 that draw off solvent from a cartridge 40 and send it to the different parts of the device, for example to perform cleaning or unblocking operations.

These means comprise a pump 41 (the $2^{nd}$ pump) and various fluid connection means, each comprising one or several conduits or one or several valves 39, 42. One of these valves, the valve 42, guides solvent to 2 possible channels, namely the print head 1 or the ink supply circuit 300. In the latter case, when the means that enable solvent to enter means 300 are themselves closed, solvent is guided to means 50. An anti-pulsation device 411 and a filter 412 may also be arranged in series with the pump.

An intermediate reservoir 14 may also be provided that may be provided with level measurement means 14' and that may be supplied from a cartridge 40, when the cartridge is connected to the circuit. Preferably, these means 14' comprise an ultrasound sensor that provides good precision for detection of the solvent level.

This reservoir 14 may send solvent to the various means 50, 300 and/or to the print head 1, and/or to the main reservoir 10 to clean them or to unblock their hydraulic components; it may also supply solvent to the main reservoir 10. Solvent can also be drawn off from the cartridge 40 and sent directly to the various elements of the circuit, to perform the same operations (cleaning or unblocking or supply of the main reservoir 10). The source of the solvent is selected by a valve 39. The «normally open» (NO) and «normally closed» (NC) positions of each valve are shown on this figure, as on the others. In this case, if the valve 39 is in the «NC» position (FIG. 4), solvent is pumped from the cartridge 40, and if it is in the «NO» position, solvent is pumped from the reservoir 14.

The reservoir 14 may be supplied from the cartridge 40, for example through a calibrated leak or restriction 45 located at its inlet. This leak also participates in generating pressure. The reservoir 14 may be filled as follows; the valve 39 is in the «NC» position (see FIG. 13), so that solvent can be pumped from cartridge 40 through the pump 41. The valve 42 is in the closed (NC) position, while inlets to means 50 and 300 are prohibited to solvent.

Solvent can be sent to these various means 50 (via duct 335), 300, then possibly to the main reservoir 10 (via duct 337), using valve 42 and means located at the inlet to means 50, 300, for example one inlet valve for each of these means. Therefore, 3 parallel channels are defined at the outlet from means 100 that, depending on the needs, will be used to send solvent to one and/or the other of these elements.

Means 100 may also comprise means 47 forming the pressure sensor, to measure the solvent pressure at the outlet from pump 41 and means 411, 412. This information can be used to detect a pressure increase in the solvent, which can be the result of a blockage in one of the conduits in which solvent flows.

Figure 11A:
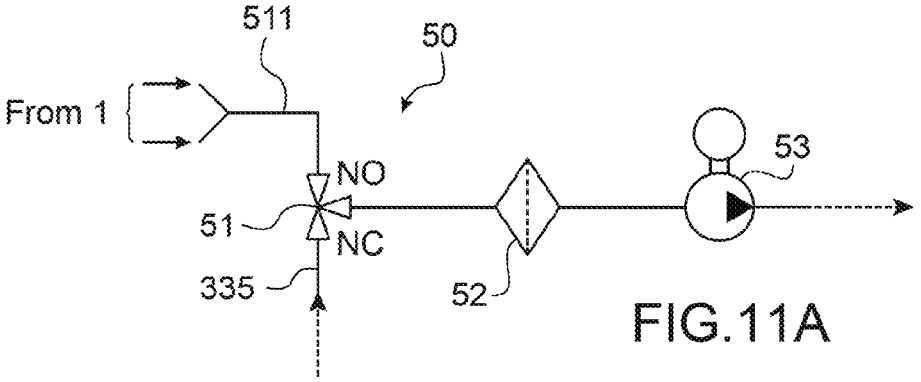

FIG. 11A shows a more detailed representation of one embodiment of means 50 that allow recovery of fluids (ink and/or solvent) that returns from the print head. Therefore, two types of fluid can be brought together at the inlet to these means 50; ink from the recovery gutter 62 (see FIG. 2) and solvent that was used to clean or rinse the print head 1 and/or the umbilical 119. A duct 511 guides these fluids to the inlet to means 50.

These means comprise a pump 53 (the 1$^{st}$ pump), possibly a filter 52 arranged in series with this pump, for example upstream from the pump, and means 51 forming the inlet valve. These means 51 comprise one or several valves, preferably a three-way valve. They exclusively send fluid either from head 1 (NO position of the valve in FIG. 5) through the duct 511, or solvent from means 100 (NC position of the valve in FIG. 5) through the duct 335, to the pump 53.

Fluid pumped by the pump 53 can then be sent to the main reservoir 10 preferably through a set of means such as disclosed in connection with FIGS. 4A-4E.

Figure 11B:
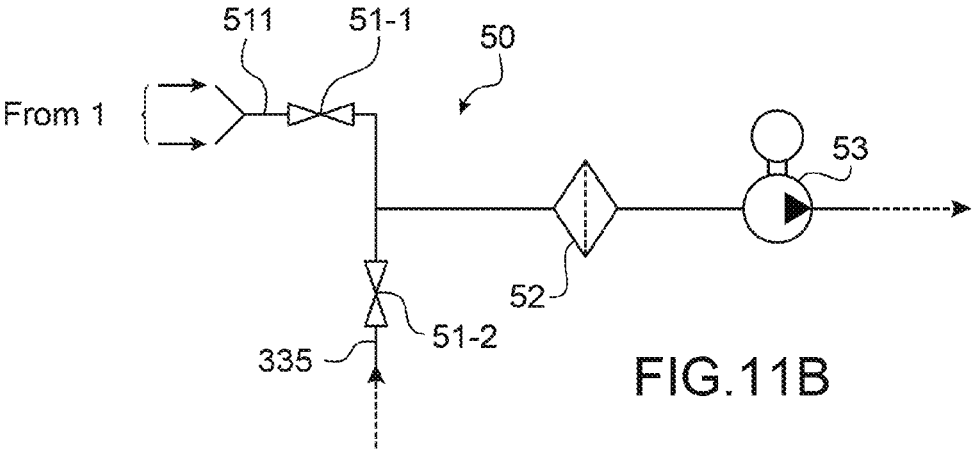

FIG. 11B shows a variant of FIG. 11A. On FIG. 11B, 2 valves 51-1 and 51-2 are implemented, instead of a three-way valve. Valve 51-1 is on duct 511, and makes it possible to interrupt a flow of fluid returning from the print head 1; valve 51-2 is on a duct through which clean solvent flows, and makes it possible to interrupt or block any flow of said clean solvent towards the pump 53. The other reference on FIG. 11B are the same as on FIG. 11A and designate the same technical elements. Through the control of valves 51-1 and 51-2 (one of said valves being closed while the other one is open), this embodiment achieves the same result as with the one of FIG. 11A: fluid is exclusively sent either from head 1 (open position of valve 51-1 in FIG. 11B and closed position of valve 51-2) through the duct 511, or solvent from means 100 (open position of the valve 51-2 in FIG. 11B and closed position of valve 51-1) through the duct 335, to the pump 53.

Figure 12:
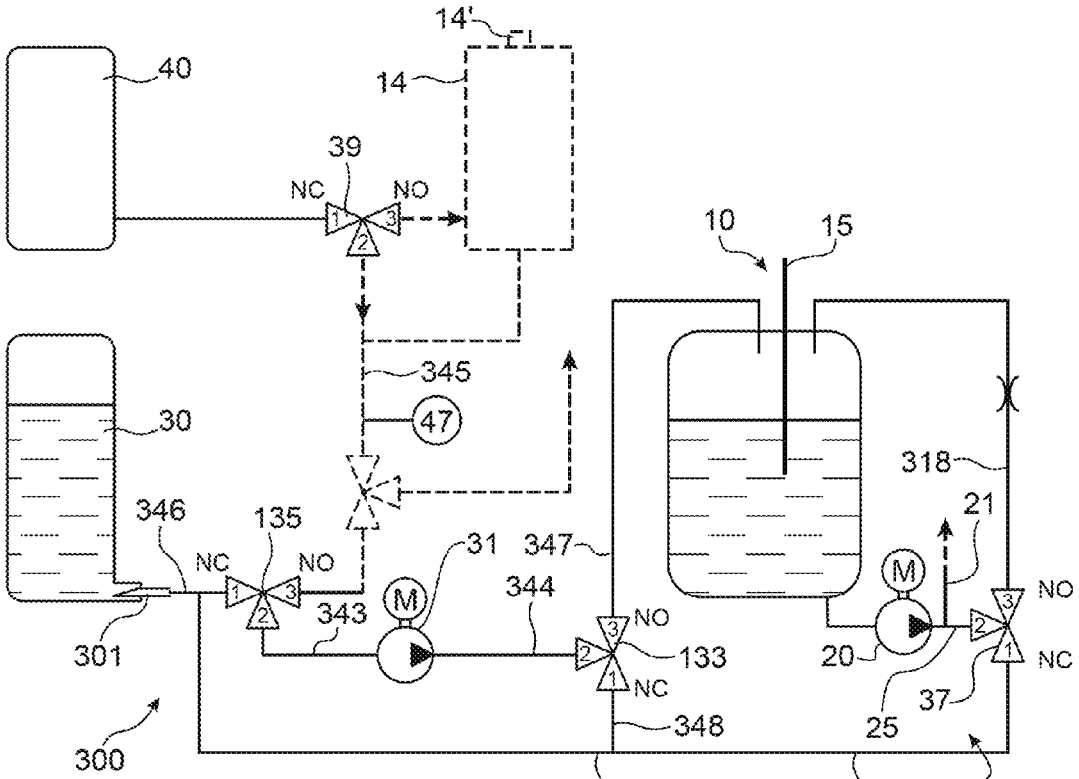

FIG. 12 shows a more detailed representation of means 300, in cooperation with the main reservoir 10 and the means 200.

The main reservoir 10 is preferably provided with means 15 for detecting the level of ink contained in it (in fact the ink in it is mixed with the solvent). In the above examples, these means may comprise one or several rods for measuring the ink level. A cap 33 according to the invention may be adapted, as already explained, for implementing these rods.

Reference 301 refers to the cannula (or any equivalent means), that will provide fluid connection between the cartridge 30 and the rest of the circuit.

When the cartridge 30 is in position and contains ink, ink may be pumped by pumping means 31 (4$^{th}$ pump) towards the main reservoir 10 through fluid connection means, comprising conduits 346, 343, 344, 347 and one or more valve(s) (or solenoid valves) 133, 135 that may be 3-way type valves. Thus, the ink transfer pump 31 pumps ink from the cartridge 30 and the ink passes in sequence through valves 135 and 133 (in positions «12 », or "NC", and «23 », or "NO" respectively in FIG. 15), and through conduits 343, 344, 347 to reach the main reservoir 10. The NO (respectively NC) state of the valve 135 corresponds to the position «23 » (respectively «12») creating connections between conduits 345 and 343 (respectively 346 and 343).

Means 345, 35, for example a duct and a valve respectively (when the valve is in position «32 » (NO) in FIG. 12) at the inlet to means 300, can be used to receive solvent from means 100. The means 300 will then increase the pressure of this solvent to a relative pressure («gauge pressure ») equal for example to between 0 and 5 bars or between 0 and 10 bars, in fluid connection means.

This solvent may be directed through the conduits 343, 344 depending on the open or closed state of the valves 135 and 133:

to reservoir 10 (through the duct 347, valve 135 in position «32 » (NO), valve 133 in position «23 » (NO)), to add solvent, for example for cleaning, into the reservoir 10;

to conduits 320 (through the duct 348, valve 135 in position «32 » (NO), valve 133 in position «21 » (NC)). Since the valve 37 is in the NO position, solvent can then be directed to the cartridge 30 through conduits 344, 348 and 320.

The means 200 at the outlet from the main reservoir 10, comprise a pump 20 (3$^{rd}$ pump, or ink pressurization pump) that pump ink from the main reservoir 10, or the fluid contained in the reservoir, and this ink or this fluid can be directed either towards the main reservoir itself (through the return duct 318 and a cover according to the invention, duct 318 joining duct 431) or towards the cartridge 30 itself (and into this cartridge) through one or several conduits 319, 320. The ink path at the outlet from the pump 20 may be controlled by means of one or several valves 37, preferably a 3-way valve. In FIG. 12, the position «21 » («NC») of valve 37 directs the ink flow towards the duct 319, and position «23 » («NO») directs the ink flow towards the duct 318. Fluid can be transferred to the print head 1 through a duct 21 that collects ink downstream from the pump 20, preferably from a location between the outlet from the pump 20 and the valve 37. The print head 1 comprises a valve that allows, or not, forming an ink jet and, possibly, printing.

Generally, the instructions to activate pumps and valves are sent and controlled by the control means 3 (also called "controller"). In particular, these instructions will control flow of solvent under pressure, from means 100 to various other means 1, and/or 50, and/or 300 of the circuit (and possibly through these latter means 300 to the main reservoir 10).

The control means 3 control the opening and the closing of each valve, as well as the activation of the pumping means, in order to circulate ink and/or solvent as disclosed in this application. In one or more memory or memory means, it also memorises data, for example ink and/or solvent level measurement data, and may also possibly process these data. The controller is also programmed to manage other operations, particularly printing operations.

The control means 3 may comprise a processor or microprocessor, programmed to implement a cleaning method according to the invention or one or several steps according to the invention.

Figure 13:
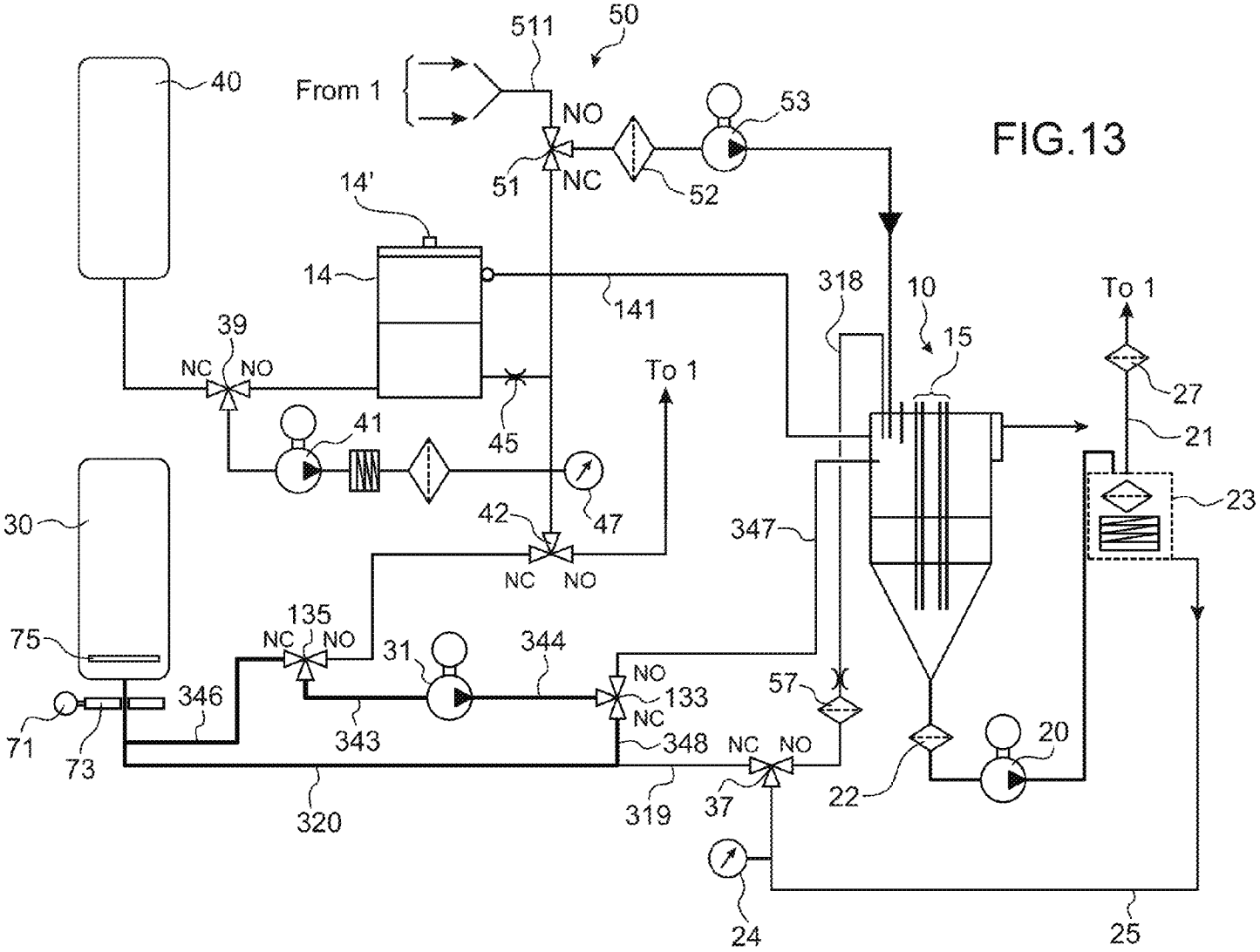

FIG. 13 shows an in ink circuit in which the circuit and the elements described above, particularly with reference to FIGS. 4B-12, can be used. The different means 10, 50, 100, 200, 300 described above are combined. In this figure, numeric reference identical to those in the previous figures refer to identical or corresponding elements.

At the outlet on the main reservoir 10, is disposed a filter 22, and then the pump 20 and an anti-pulsation device 23. A pressure sensor 24, and, possibly, a temperature sensor can be provided, as illustrated in the figure: the data it provides are used by the controller to control the ink pressure to a set point, generally when the ink jet speed in the head is not available (for example when the jet ejection is stopped, or when the jet speed is not measurable). As already indicated above, the ink is sent to the printing head 1, via the duct 21, connected downstream of the anti-pulsation device 23, between the pump 20 and the valve 37. The printing head contains itself a valve which enables to allow, or not, an ink jet and possibly a printing to be produced.

The ink is filtered by the main filter 27 downstream of the sensor 24 before it is sent to the head 1.

The intermediate reservoir 14 has been described above. A duct 141 can be used to bring the free volume located above each of the liquids contained in the reservoirs 10 and 14 to the same atmospheric pressure. This duct can be connected to the duct 331', described above in connection with FIG. 4A.

It should be noted that when the valve 42 is in the «NC» position while valve 35 is in the «NC» position, solvent flow is blocked both towards the cartridge 30 and towards the duct 343; therefore, solvent is thus directed to valve 51 or to restriction 45 (and then enters the intermediate reservoir 14).

It is understood that solvent and/or ink, from the cartridges 30, 40 can be sent to the reservoir. These additions are made occasionally over time, preferably upon instructions by the control means. The ink circulation, from the reservoir bottom to the lid, as explained in connection with FIGS. 8A and 8B, is in turn continuous over time. Recovering ink from the head depends on the jet being started.

The invention is particularly useful for ink containing dense particle dispersions such as metals or metal oxide pigments, for example titanium, zinc, chromium, cobalt or Iron (such as $TiO_2$, ZnO, $Fe_2O_3$, $Fe_3O_4$, etc.) in the form of micronic or sub-micronic particles. Such a pigment ink can for example be based on $TiO_2$, and can be used for marking and identification of black or dark supports.

But it is also useful in the case of a non-pigment ink that can dry and form deposits of dry material in the conduits and connections of the ink circuit, as described above.

The invention claimed is:

1. A reservoir lid for a continuous ink jet printer comprising a so-called upper surface, a so-called lower surface, between which are included an upper part and a lower part of the lid, at least the lower part of the lid having a peripheral side surface, and:

at least one $1^{st}$ duct, which passes through at least one part of the lid, for leading a $1^{st}$ fluid from said upper part to said lower part and directing said $1^{st}$ fluid, at least partly, sideways, to said peripheral side surface, at least one $1^{st}$ chamber defined by an internal surface of the lid into which said at least one $1^{st}$ duct opens and by said peripheral side surface, and at least one aperture for flowing a liquid contained in said at least one $1^{st}$ chamber along said peripheral side surface.

2. The lid according to claim 1, wherein at least said $1^{st}$ duct passes at least through one part of the lid along at least one direction parallel to the peripheral side surface or at least one part of the duct is directed to said peripheral side surface ($S_e$) along a direction forming, with said peripheral surface, an angle between 30° and 60°.

3. The lid according to claim 1, said peripheral side surface being cylindrical.

4. The lid according to claim 1, said lower part including at least one peripheral part which projects from said lower surface, at least one part of said $1^{st}$ chamber being made in said peripheral part.

5. The lid according to claim 1, further including at least one of:

at least a support for receiving at least one rod for measuring a liquid level in the reservoir;

fluid connections, on the upper surface, for leading at least the $1^{st}$ fluid to an inlet of the $1^4$ duct;

fluid connections including an inlet for leading the $1^{st}$ fluid along a direction perpendicular to the peripheral side surface;

a side seal disposed between said $1^{st}$ chamber and the upper surface to perform a sealing with the wall of a reservoir;

at least one duct which passes through the upper part and which opens into the lower part or into a cavity delimited by the lower part.

6. The lid according to claim 1, including at least one $2^{nd}$ duct, which passes through at least one part of the lid, to lead a $2^{nd}$ fluid from said upper part to said lower part and direct said $2^{nd}$ fluid at least partly, sideways, to said peripheral side surface, this $2^{nd}$ duct opening into the $1^{st}$ chamber.

7. The lid according to claim 6, the $1^{st}$ duct and the $2^{nd}$ duct being at least partly parallel to each other.

8. The lid according to claim 6, the aperture for flowing a liquid contained in the chamber including a surface, the $1^{st}$ duct, respectively the $2^{nd}$ duct, opening into the $1^{st}$ chamber through a $1^{st}$ port, respectively a $2^{nd}$ port, the sum of the area of the $1^{st}$ port and the $2^{nd}$ port, which pass through the $1^{st}$ fluid and the $2^{nd}$ fluid, being lower than or equal to said surface the area of said aperture.

9. The lid according to claim 6, including:

at least one $3^{rd}$ duct, which passes through at least one part of the lid, for leading a liquid from said upper part to said lower part and directing said liquid, at least partly, sideways, to said peripheral side surface, at least one $2^{nd}$ chamber defined by an internal surface of said lid into which said $3^{rd}$ duct opens and by said peripheral side surface, and an at least an aperture for flowing the liquid from said at least one $2^{nd}$ chamber along a direction parallel to said peripheral side surface.

10. The lid according to claim 9, said $3^{rd}$ duct alone opening into said chamber.

11. A continuous ink jet printer, including:

an ink circuit including a reservoir including a body and a lid according to claim 9, at least the $1^{st}$ chamber being closed, sideways, by the internal wall of the reservoir body, a printing head, hydraulic connections for leading:

to the $1^{st}$ duct, an ink recovered at the bottom of the reservoir, to the $2^{nd}$ duct, an ink or a solvent from an ink or solvent supply circuit, to the $3^{rd}$ duct, an ink to be recovered from the printing head, electrical connections for electrically supplying said printing head.

12. A continuous ink jet printer, including:

an ink circuit including a reservoir including a body and a lid according to claim 6, at least the $1^{st}$ chamber being closed, sideways, by the internal wall of the reservoir body, a printing head, hydraulic connections, for leading, from the ink reservoir, an ink to be printed to the printing head, hydraulic connections, for leading to the $1^{st}$ duct an ink recovered at the bottom of the reservoir and, to the $2^{nd}$ duct, an ink or a solvent from an ink or solvent supply circuit, electrical connections for electrically supplying said printing head.

13. The lid according to claim 1, said $1^{st}$ duct alone opening into said $1^{st}$ chamber.

14. A continuous ink jet printer, including:

an ink circuit including a reservoir including a body and a lid according to claim 13, at least the $1^{st}$ chamber being closed, sideways, by the internal wall of the reservoir body, a printing head, hydraulic connections, for leading, from the ink reservoir, an ink to be printed to the printing head, hydraulic connections for leading an ink to be recovered from the printing head to the $1^{st}$ duct, electrical connections for electrically supplying said printing head.

15. A reservoir including a body and a lid according to claim 1, at least the $1^{st}$ chamber being closed, sideways, by the internal wall of the reservoir body.

16. The reservoir according to claim 15, including hydraulic connections for transferring ink, contained in the reservoir, to said $1^{st}$ duct of the lid.

17. A continuous ink jet printer, including:

an ink circuit including a reservoir according to claim 15, a printing head, hydraulic connections, for leading, from the ink reservoir, an ink to be printed to the printing head, electrical connections for electrically supplying said printing head.

18. A method for operating a continuous ink jet printer, said continuous ink jet printer comprising:

an ink circuit including a reservoir including a body and a lid, said lid including:

a so-called upper surface, a so-called lower surface, between which are included an upper part and a lower part of the lid, at least the lower part of the lid having a peripheral side surface, at least one $1^{st}$ duct, which passes through at least one part of the lid, for leading a $1^{st}$ fluid from said upper part to said lower part and directing said $1^{st}$ fluid, at least partly, sideways, to said peripheral side surface, and at least one $1^{st}$ chamber defined by an internal surface of the lid into which said at least one $1^{st}$ duct opens and by said peripheral side surface, and at least one aperture for flowing a liquid contained in said at least one $1^{st}$ chamber along said peripheral side surface, wherein said $1^{st}$ duct alone opens into said $1^{st}$ chamber, and at least the $1^{st}$ chamber being closed, sideways, by the internal wall of the reservoir body, a printing head, hydraulic connections, for leading, from the ink reservoir, an ink to be printed to the printing head, hydraulic connections for leading an ink to be recovered from the printing head to the $1^{st}$ duct, and electrical connections for electrically supplying said printing head, in which ink is recovered from the printing head and sent to the $1^{st}$ duct, and then in the $1^{st}$ chamber, the ink then flowing along the internal wall of the reservoir.

19. A method for operating a continuous ink jet printer, said continuous ink jet printer comprising:

an ink circuit including a reservoir including a body and a lid, said lid including:

a so-called upper surface, a so-called lower surface, between which are included an upper part and a lower part of the lid, at least the lower part of the lid having a peripheral side surface, at least one $1^{st}$ duct, which passes through at least one part of the lid, for leading a $1^{st}$ fluid from said upper part to said lower part and directing said $1^{st}$ fluid, at least partly, sideways, to said peripheral side surface, at least one $1^{st}$ chamber defined by an internal surface of the lid into which said at least one $1^{st}$ duct opens and by said peripheral side surface, and at least one aperture for flowing a liquid contained in said at least one $1^{st}$ chamber along said peripheral side surface, at least one $2^{nd}$ duct, which passes through at least one part of the lid, to lead a $2^{nd}$ fluid from said upper part to said lower part and direct said $2^{nd}$ fluid at least partly, sideways, to said peripheral side surface, this $2^{nd}$ duct opening into the $1^{st}$ chamber, and at least the $1^{st}$ chamber being closed, sideways, by the internal wall of the reservoir body, a printing head, hydraulic connections, for leading, from the ink reservoir, an ink to be printed to the printing head, hydraulic connections, for leading to the $1^{st}$ duct an ink recovered at the bottom of the reservoir and, to the $2^{nd}$ duct, an ink or a solvent from an ink or solvent supply circuit, and electrical connections for electrically supplying said printing head, wherein:

ink is recovered at the bottom of the reservoir and led into the $1^{st}$ duct, forming a $1^{st}$ ink flow in the $1^{st}$ chamber, ink, or solvent, is sent, by the ink supply circuit, into the $2^{nd}$ duct, forming a $2^{nd}$ fluid flow, in the $1^{st}$ chamber, and both flows being mixed with each other in said $1^{st}$ chamber, forming a mixture which flows along the internal wall of the reservoir.

20. A method for operating a continuous ink jet printer, the continuous ink jet printer comprising:

an ink circuit including a reservoir including a body and a lid, the lid including:

a so-called upper surface, a so-called lower surface, between which are included an upper part and a lower part of the lid, at least the lower part of the lid having a peripheral side surface, and:

at least one $1^{st}$ duct, which passes through at least one part of the lid, for leading a $1^{st}$ fluid from said upper part to said lower part and directing said $1^{st}$ fluid, at least partly, sideways, to said peripheral side surface, at least one $1^{st}$ chamber defined by an internal surface of the lid into which said at least one $1^{st}$ duct opens and by said peripheral side surface, and at least one aperture for flowing a liquid contained in said at least one $1^{st}$ chamber along said peripheral side surface, at least one $2^{nd}$ duct, which passes through at least one part of the lid, to lead a $2^{nd}$ fluid from said upper part to said lower part and direct said $2^{nd}$ fluid at least partly, sideways, to said peripheral side surface, this $2^{nd}$ duct opening into the $1^{st}$ chamber, at least one $3^{rd}$ duct, which passes through at least one part of the lid, for leading a liquid from said upper part to said lower part and directing said liquid, at least partly, sideways, to said peripheral side surface, at least one $2^{nd}$ chamber defined by an internal surface of the lid into which said duct opens and by said peripheral side surface, and an at least an aperture for flowing the liquid from this $2^{nd}$ chamber along a direction parallel to said peripheral side surface, and at least the $1^{st}$ chamber being closed, sideways, by the internal wall of the reservoir body, a printing head, hydraulic connections, for leading, from the ink reservoir, an ink to be printed to the printing head, hydraulic connections for leading:

to the $1^{st}$ duct, an ink recovered at the bottom of the reservoir, to the $2^{nd}$ duct, an ink or a solvent from an ink or solvent supply circuit, to the $3^{rd}$ duct, an ink to be recovered from the printing head, and electrical connections for electrically supplying said printing head, wherein:

ink is recovered at the bottom of the reservoir and led into the $1^{st}$ duct, forming a $1^{st}$ ink flow in the $1^{st}$ chamber, ink, or solvent, is sent, by the ink supply circuit, into the $2^{nd}$ duct, forming a $2^{nd}$ fluid flow, in the $1^{st}$ chamber, and both flows being mixed with each other in said $1^{st}$ chamber, forming a mixture which flows along the internal wall of the reservoir.

* * * * *